US009045880B2

(12) United States Patent
Horii

(10) Patent No.: US 9,045,880 B2
(45) Date of Patent: Jun. 2, 2015

(54) OPERATING MACHINE

(75) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 174 days.

(21) Appl. No.: 13/527,657

(22) Filed: Jun. 20, 2012

(65) Prior Publication Data

US 2012/0330516 A1 Dec. 27, 2012

(30) Foreign Application Priority Data

Jun. 21, 2011 (JP) ..... P2011-137392

(51) Int. Cl.
*F16H 61/46* (2010.01)
*E02F 9/22* (2006.01)

(52) U.S. Cl.
CPC ..... *E02F 9/2246* (2013.01); *E02F 9/2239* (2013.01); *E02F 9/2285* (2013.01); *E02F 9/2292* (2013.01); *E02F 9/2296* (2013.01)

(58) Field of Classification Search
CPC ..... F16H 61/4043; F16H 61/465
USPC ..... 701/50; 60/421, 422, 452, 429, 430; 91/446–448, 436; 137/596.12, 596.13
See application file for complete search history.

(56) References Cited

U.S. PATENT DOCUMENTS

| | | | | |
|---|---|---|---|---|
| 5,722,190 | A * | 3/1998 | Arnold | 37/348 |
| 5,832,729 | A * | 11/1998 | Reid et al. | 60/421 |
| 6,170,261 | B1 * | 1/2001 | Ishizaki et al. | 60/421 |
| 7,412,826 | B2 * | 8/2008 | Horii | 60/421 |

FOREIGN PATENT DOCUMENTS

| | | | |
|---|---|---|---|
| EP | 2 042 661 | A2 | 4/2009 |
| JP | 2004-346999 | A | 12/2004 |
| JP | 2006-83696 | A | 3/2006 |
| JP | 3974076 | B2 | 9/2007 |
| JP | 2008-291913 | A | 12/2008 |

* cited by examiner

*Primary Examiner* — Dalena Tran
(74) *Attorney, Agent, or Firm* — Birch, Stewart, Kolasch & Birch, LLP

(57) ABSTRACT

There is provided a split-flow hydraulic pump-equipped operating machine. The travel independent valve is designed to be switched to the merging position in the case of driving the front working device without actuation of the travel device or in the case of driving the travel device and the front working device concurrently, and switched to the independently feeding position in the case of driving the travel device without actuation of the front working device. The load sensing system controls the discharge flow rate of the hydraulic pump on the basis of a pressure difference between the discharge pressure of the hydraulic pump and the maximum load pressure of the hydraulic actuator in any of the case of driving the travel device, the case of driving the front working device, and the case of driving both the travel device and the front working device.

6 Claims, 9 Drawing Sheets

OPERATING MACHINE

CROSS-REFERENCE TO RELATED APPLICATIONS

The present application claims priority under 35 USC 119 to Japanese Patent Application No. JP-2011-137392 filed Jun. 21, 2011, which application is incorporated in its entirety.

The present invention relates to an operating machine such as a backhoe.

FIELD OF INVENTION

As a heretofore known operating machine, there is a backhoe described in Japanese Unexamined Patent Publication JP-A 2006-83696. The backhoe comprises a travel unit, a swivel base mounted for swivel motion on the travel unit, a front working device disposed at the front of the swivel base, and a dozer device disposed at the front of the travel unit.

The travel unit is provided with a pair of right-hand and left-hand travel devices that are driven by a travel motor. The dozer device is provided with a blade which is raised and lowered by a dozer cylinder. The swivel base is driven to swivel by a swivel motor.

At the front of the swivel base is disposed a swing bracket configured for right-left swinging motion. The swing bracket is driven to swing to right and left by a swing cylinder.

The front working device comprises a boom pivotally coupled to the swing bracket, an arm pivotally coupled to the boom, and a bucket pivotally coupled to the arm. The boom, the arm, and the bucket are driven to rock by a boom cylinder, an arm cylinder, and a bucket cylinder, respectively.

The travel motor and the swivel motor are each constructed of a hydraulic motor. The dozer cylinder, the swing cylinder, the boom cylinder, the arm cylinder, and the bucket cylinder are each constructed of a hydraulic cylinder. The thusly constructed operating machine is equipped with a hydraulic system having a load sensing system.

The hydraulic system comprises a main pump constructed of a split flow-type hydraulic pump capable of discharge flow control, a sub pump constructed of a hydraulic pump which is not designed for flow control, a flow control section for exercising discharge flow control over the main pump, and a travel independent valve for changing the direction of oil discharge from the main pump.

The travel independent valve is configured to be switchable between an independently feeding position for effecting the supply of pressure oil from the first discharge port of the main pump to one of travel control valves and the supply of pressure oil from the second discharge port of the main pump to the other one of travel control valves, and a merging position for merging pressure oil from the first discharge port with pressure oil from the second discharge port to effect the supply of the pressure oil to a boom control valve, an arm control valve, a bucket control valve, and a swing control valve, respectively. The travel independent valve is switched to the independently feeding position in a traveling state, and is switched to the merging position in a non-traveling state.

Moreover, in the non-traveling state, oil discharged from the sub pump can be fed to a swivel control valve and a dozer control valve. On the other hand, in the traveling state, the oil can be fed to, in addition to the above valves, the boom control valve, the arm control valve, the bucket control valve, and the swing control valve.

The boom control valve, the arm control valve, the bucket control valve, and the swing control valve each have built-in direction selector valve and pressure compensation valve. The direction selector valve serves to change the direction of pressure oil for a target hydraulic actuator. The pressure compensation valve serves, when two or more of hydraulic actuators that are controlled by those control valves are operated concurrently, to perform load adjustment for the individual hydraulic actuators.

By virtue of the pressure compensation valve, it is possible to cause, in a control valve at a lower load-pressure level, a pressure loss in an amount equivalent to the pressure difference from the maximum load pressure, and thereby allow oil passage through the control valve at a flow rate based on the range of operation of the spool of the control valve regardless of the magnitude of load.

Moreover, in this hydraulic system, in the case of operating two or more of the boom cylinder, the arm cylinder, the bucket cylinder, and the swing cylinder concurrently in the non-traveling state, out of the load pressures of the operated hydraulic actuators, the maximum load pressure is transferred, in the form of PLS signal pressure, to the flow control section. In addition, the discharge pressure of the main pump is transferred, in the form of PPS signal pressure, to the flow control section. In the flow control section, the discharge flow rate of the main pump is automatically controlled (load sensing control) in such a manner that the PPS signal pressure minus the PLS signal pressure can be maintained as a set value.

Meanwhile, in the traveling state, the main pump is kept at its maximum capacity.

In addition, as another operating machine, there is an operating machine described in Japanese Examined Patent Publication JP-B2 3974076.

The hydraulic system of this operating machine comprises a split-flow-type main pump, right-side and left-side travel control valves for controlling right-side and left-side travel motors, respectively, a boom control valve for controlling a boom cylinder, an arm control valve for controlling an arm cylinder, a bucket control valve for controlling a bucket cylinder, and a travel independent valve for changing the direction of oil discharge from the main pump.

The travel independent valve is configured to be switchable between an independently feeding position for effecting the supply of pressure oil from the first discharge port of the main pump to one of the travel control valves and the supply of pressure oil from the second discharge port of the main pump to the other one of the travel control valves in a traveling state, and a merging position for merging pressure oil from the first discharge port with pressure oil from the second discharge port to effect the supply of the pressure oil to the boom control valve, the arm control valve, and the bucket control valve, respectively, during the operation of a front working device.

Moreover, in this operating machine, the main pump is placed under negative control in the traveling state, and is placed under load sensing control during the driving operation of the front working device.

SUMMARY OF THE INVENTION

Problems to be Solved by the Invention

In the operating machine described in Japanese Unexamined Patent Publication JP-A 2006-83696, a compact, inexpensive split-flow-type main pump is adopted for use from the standpoint of low cost and ease of installation. Moreover, in the traveling state, pressure oil from one of the discharge ports of the main pump and pressure oil from the other are fed independently to the right-side and left-side travel motors, respectively, for the attainment of high steering performance.

However, in this operating machine, in the traveling state, the main pump is kept at its maximum capacity without flow control. In this case, out of the discharge flow from the main pump, an unnecessary portion which is not used in the travel motor is returned to a tank, in consequence whereof there results a waste of hydraulic oil discharge.

Furthermore, in the case of performing a combination of the operation of the travel device and the operation of the front working device, the front working device is driven by pressure oil from the sub pump. With the sub pump alone, there is a likelihood of insufficient flow rate (slowing-down in motion). In addition, the sub pump is not flow-controlled, which results in energy loss.

On the other hand, the operating machine described in Japanese Examined Patent Publication JP-B2 3974076 affords cost and installation advantages because of the use of a split-flow-type main pump, and also succeeds in energy saving, because the main pump is placed under flow control of discharge oil in the traveling state or during the operation of the front working device. Moreover, in the traveling state, pressure oil from one of the discharge ports of the main pump and pressure oil from the other are fed independently to the right-side and left-side travel control valves, respectively, for the attainment of high steering performance.

However, this operating machine is at a disadvantage in that, since the main pump is placed under negative control in the traveling state and is placed under load sensing control during the operation of the front working device, it is impossible to exercise split-flow control so that the discharge oil from the main pump can be split up so as to flow to each of the travel control valve, the boom control valve, the arm control valve, and the bucket control valve, respectively, during the combined operation of the travel device and the front working device.

The present invention has been devised in view of the problems as mentioned supra, and accordingly an object of the present invention is to provide a split-flow hydraulic pump-equipped operating machine capable of ensuring high steering performance, imparting high operation performance capability to a front working device, and achieving energy saving (fuel efficiency, heat balance) successfully.

By way of the implementation of a technical measure taken by the present invention to solve the foregoing technical problems, there is provided with an operating machine, comprising: right-side and left-side travel devices; a hydraulic actuator for driving the left-side travel device; a hydraulic actuator for driving the right-side travel device; a front working device; a hydraulic actuator for driving the front working device; a variable displacement hydraulic pump for discharging pressure oil to be fed to each of the hydraulic actuators, the variable displacement hydraulic pump being a split-flow-type and having a first discharge port P1 and a second discharge port P2 both for discharging the pressure oil to each of the hydraulic actuators; and a travel independent valve configured to be switchable between:

a merging position for merging the pressure oil from the first discharge port P1 of the hydraulic pump with the pressure oil from the second discharge port P2 of the hydraulic pump to effect the supply of the pressure oil to the hydraulic actuators; and an independently feeding position for independently effecting the supply of the pressure oil from the first discharge port P1 of the hydraulic pump to the hydraulic actuator of the right-side travel device and the supply of the pressure oil from the second discharge port P2 to the hydraulic actuator of the left-side travel device, the travel independent valve being switched to the merging position in a case of driving the front working device without actuation of either of the right-side or the left-side travel devices, or a case of driving each of the right-side and the left-side travel devices and the front working device concurrently, or being switched to the independently feeding position in a case of driving each of the right-side and the left-side travel devices without actuation of the front working device.

The operating machine is further provided with a load sensing system adapted to control a discharge flow rate of the variable displacement hydraulic pump based on a pressure difference between: a discharge pressure of the split-flow-type variable displacement hydraulic pump; and a maximum load pressure that is a highest one of the load pressures of the hydraulic actuators of the right-side and left-side travel devices and the front working device in any one of a case where the travel independent valve is in the merging position and in a case where the travel independent valve is in the independently feeding position.

The operating machine pursuant to the present invention further provided with a regulator for controlling the swash plate of the hydraulic pump; and a signal selection valve device capable of transmitting the higher one of the load pressure of the hydraulic actuator of the right-side travel device and the load pressure of the hydraulic actuator of the left-side travel device, as well as the higher one of the discharge pressure of the first discharge port and the discharge pressure of the second discharge port, to the regulator when the travel independent valve is set in the independently feeding position.

The operating machine pursuant to the present invention is further provided with a load sensing system includes a PLS signal transmission oil path which permits transmission of the maximum load pressure among the load pressures of the hydraulic actuators when the travel independent valve is set in the merging position, and is divided into a first line for transmission of the load pressure of the hydraulic actuator of the right-side travel device and a second line for transmission of the load pressure of the hydraulic actuator of the left-side travel device when the travel independent valve is set in the independently feeding position.

Moreover, the signal selection valve device is composed of a PPS signal shuttle valve which has its one input port connected to a first discharge path for allowing passage of pressure oil from the first discharge port, has its other input port connected to a second discharge path for allowing passage of pressure oil from the second discharge port, and has its output port connected to the regulator; and a PLS signal shuttle valve which has its one input port connected to the first line, has its other input port connected to the second line, and has its output port connected to the regulator.

The operating machine pursuant to the present invention is further provided with a right-side travel control valve for controlling the hydraulic actuator of the right-side travel device and a left-side travel control valve for controlling the hydraulic actuator of the left-side travel device. The right-side travel control valve is operated by a pilot pressure from a right-side travel operation valve, and the left-side travel control valve is operated by a pilot pressure from a left-side travel operation valve.

There is also provided a travel bypass valve configured to be switchable among a blocking position for blocking the flow of pressure oil between the first discharge path and the second discharge path, a first switching position for permitting a one-way flow of pressure oil from the second discharge path to the first discharge path, and a second switching position for permitting a one-way flow of pressure oil from the first discharge path to the second discharge path. A pilot pressure from the right-side travel operation valve acts in a direction to switch the travel bypass valve from the blocking position to the first switching position, and a pilot pressure from the left-side travel operation valve acts in a direction to switch the travel bypass valve from the blocking position to the second switching position.

When a pressure difference of greater-than-predetermined level is produced between a pilot pressure from the right-side travel operation valve and a pilot pressure from the left-side travel operation valve, then the travel bypass valve is switched from the blocking position to the first switching position or the second switching position by the higher one of those pilot pressures.

The operating machine pursuant to the present invention is further provided with a coupling oil path for establishing coupling between the first discharge path for allowing passage of pressure oil from the first discharge port and the second discharge path for allowing passage of pressure oil from the second discharge port and a PLS signal transmission oil path for permitting transmission of the maximum load pressure among the load pressures of the hydraulic actuators. There are also provided a right-side travel operation valve for operating, by a pilot pressure, the right-side travel control valve for controlling the right-side travel device, and a left-side travel operation valve for operating, by a pilot pressure, the left-side travel control valve for controlling the left-side travel device. The signal selection valve device is composed of a signal selection valve constructed of a switching valve configured to be switchable among a neutral position, a first switching position, and a second switching position; and a deselecting valve configured to be switchable between an active position and an inactive position.

The signal selection valve is disposed on the coupling oil path as well as the PLS signal transmission oil path. The signal selection valve allows transmission of the pressure of the coupling oil path, as well as the pressure of the PLS signal transmission oil path, to the regulator when set in the neutral position, effects division of the coupling oil path, as well as the PLS signal transmission oil path, for transmission of the discharge pressure of the first discharge path and the load pressure of the hydraulic actuator of the right-side travel device to the regulator when set in the first switching position, and effects division of the coupling oil path, as well as the PLS signal transmission oil path, for transmission of the discharge pressure of the second discharge path and the load pressure of the hydraulic actuator of the left-side travel device to the regulator when set in the second switching position. The deselecting valve causes a pilot pressure from the right-side travel operation valve to act in a direction to switch the signal selection valve from the neutral position to the first switching position and also causes a pilot pressure from the left-side travel operation valve to act in a direction to switch the signal selection valve from the neutral position to the second switching position when set in the active position, and prevents a pilot pressure from the right-side travel operation valve as well as a pilot pressure from the left-side travel operation valve from acting upon the signal selection valve to bring the signal selection valve into the neutral position when set in the inactive position.

The operating machine pursuant to the present invention, the deselecting valve is switched to the active position by a pilot pressure for switching the travel independent valve to the independently feeding position, and is switched to the inactive position by a pilot pressure for switching the travel independent valve to the merging position.

According to the present invention, the travel independent valve is switched to the merging position in the case of driving the front working device without actuation of the travel device or the case of driving the travel device and the front working device concurrently, and is switched to the independently feeding position in the case of driving the travel device without actuation of the front working device. Moreover, load sensing control is performed on the discharge flow rate of the hydraulic pump on the basis of a pressure difference between the discharge pressure of the hydraulic pump and the maximum load pressure of the hydraulic actuator in any one of the case of driving the travel device, the case of driving the front working device, and the case of driving both the travel device and the front working device. By virtue of such structural features, it is possible to provide a split-flow hydraulic pump-equipped operating machine having cost and installation advantages that is capable of ensuring high steering performance, imparting high operation performance capability to a front working device, and achieving energy saving (fuel efficiency, heat balance) successfully.

According to the present invention, in the case of making a turn during the driving operation of the travel device alone, the signal selection valve device serves to transmit the higher one of the load pressure of the hydraulic actuator of the right-side travel device and the load pressure of the hydraulic actuator of the left-side travel device, as well as the higher one of the pump discharge pressure of the first discharge port and the pump discharge pressure of the second discharge port, to the regulator for flow control over the hydraulic pump. Accordingly, even with the placement of a split-flow-type hydraulic pump, the operating machine is capable of exercising load sensing control satisfactorily at the time of a turn.

According to the present invention, in the case of the driving the front working device alone, the case of driving both the travel device and the front working device, or the case of driving the travel device alone for straight-ahead travel, the discharge pressure of the hydraulic pump is transferred to the regulator through the PPS signal shuttle valve, and also the maximum load pressure of the hydraulic actuator is transferred to the regulator through the PLS signal shuttle valve. On the basis of a pressure difference between the discharge pressure of the hydraulic pump and the maximum load pressure of the hydraulic actuator, the discharge flow rate of the hydraulic pump is controlled.

Moreover, in the case of making a turn during the driving operation of the travel device alone, the higher one of the pump discharge pressure of the right-side travel device and that of the left-side travel device and the higher one of the actuator load pressure of the right-side travel device and that of the left-side travel device are transferred to the regulator through the PPS signal shuttle valve and the PLS signal shuttle valve to control the discharge flow rate of the hydraulic pump.

Accordingly, the split-flow-type hydraulic pump can be placed under load sensing control in any one of the case of driving the travel device, the case of driving the front working device, and the case of driving both the travel device and the front working device.

Moreover, as a feature of the circuit configuration in this construction, the shuttle valve is adopted for the transmission of pump discharge pressure and actuator load pressure to the regulator. This makes it possible to simplify the circuit configuration of the load sensing system, and thereby obtain a cost advantage.

According to the present invention, the following advantageous effects can be attained.

During traveling on the flat ground, for example, in the case of making a turn to the left, when the right-side travel control valve is so operated as to rev up the hydraulic actuator of the right-side travel device, then the hydraulic actuator of the right-side travel device becomes higher in load pressure than the hydraulic actuator of the left-side travel device, and also the hydraulic oil which is fed to the hydraulic actuator of the right-side travel device becomes higher in pressure than that which is fed to the hydraulic actuator of the left-side travel device. Therefore, the load pressure of the hydraulic actuator of the right-side travel device is transferred to the regulator via the PLS signal shuttle valve, and also the discharge pressure of the hydraulic pump which is transferred to the hydraulic actuator of the right-side travel device is transferred to the regulator. On the basis of the PLS signal pressure and the PPS signal pressure, the discharge flow rate of the hydraulic pump is controlled in a manner to make a turn successfully.

Moreover, in the case of making a turn to the left during forward downhill travel, as a pilot pressure from the right-side travel operation valve is increased, discharge oil from the hydraulic pump which is fed to the left-side travel control valve is fed to the right-side travel control valve. Thereby, the pressure-oil supply system for the hydraulic actuator of the right-side travel device can be maintained at a high-pressure level; wherefore the hydraulic pump can be flow-controlled properly on the basis of the PLS signal pressure and the PPS signal pressure from the right-side travel device. This makes it possible to achieve a turn successfully even on a downhill run.

Further, there is no problem with a turn on the flat ground, because discharge oil from the hydraulic pump is restrained from flowing from, out of the right-side and left-side travel operation valves, the one at a higher pilot-pressure level to the other at a lower pilot-pressure level.

In addition, in a case where a pilot pressure from the right-side travel operation valve and a pilot pressure from the left-side travel operation valve stand at the same pressure level, the travel bypass valve is set in the blocking position. Therefore, since there is no pressure-oil flow between the first discharge path and the second discharge path of the hydraulic pump, it is possible to ensure straight-ahead travel capability.

According to the present invention, in the case of driving the front working device alone or the case of driving both the travel device and the front working device, the deselecting valve is set in the inactive position, and the signal selection valve is set in the neutral position. Then, the discharge pressure of the hydraulic pump and the load pressure of the hydraulic actuator of the travel device are transferred to the regulator to control the discharge flow rate of the hydraulic pump.

Moreover, in the case of driving the travel device alone, the deselecting valve is set in the active position, and, when straight-ahead travel is effected in this case, the signal selection valve is set in the neutral position. Then, the discharge pressure of the hydraulic pump and the load pressure of the hydraulic actuator of the travel device are transferred to the regulator to control the discharge flow rate of the hydraulic pump. Further, in the case of making a turn during the driving operation of the travel device alone, the signal selection valve is switched to the first switching position or the second switching position by a pilot pressure from the travel operation valve at a higher pressure level. In this way, discharge flow control is performed on the hydraulic pump by the pump discharge pressure and the actuator load pressure of the travel device which is operated by the travel operation valve at a higher pilot-pressure level.

Accordingly, the split-flow-type hydraulic pump can be placed under load sensing control in any one of the case of driving the travel device, the case of driving the front working device, and the case of driving both the travel device and the front working device.

According to the present invention, the deselecting valve is switched between the active position and the inactive position by a pilot pressure used for switching operation of the travel independent valve. This makes it possible to achieve structural simplification.

DETAILED DESCRIPTION OF THE INVENTION

Figure 1:
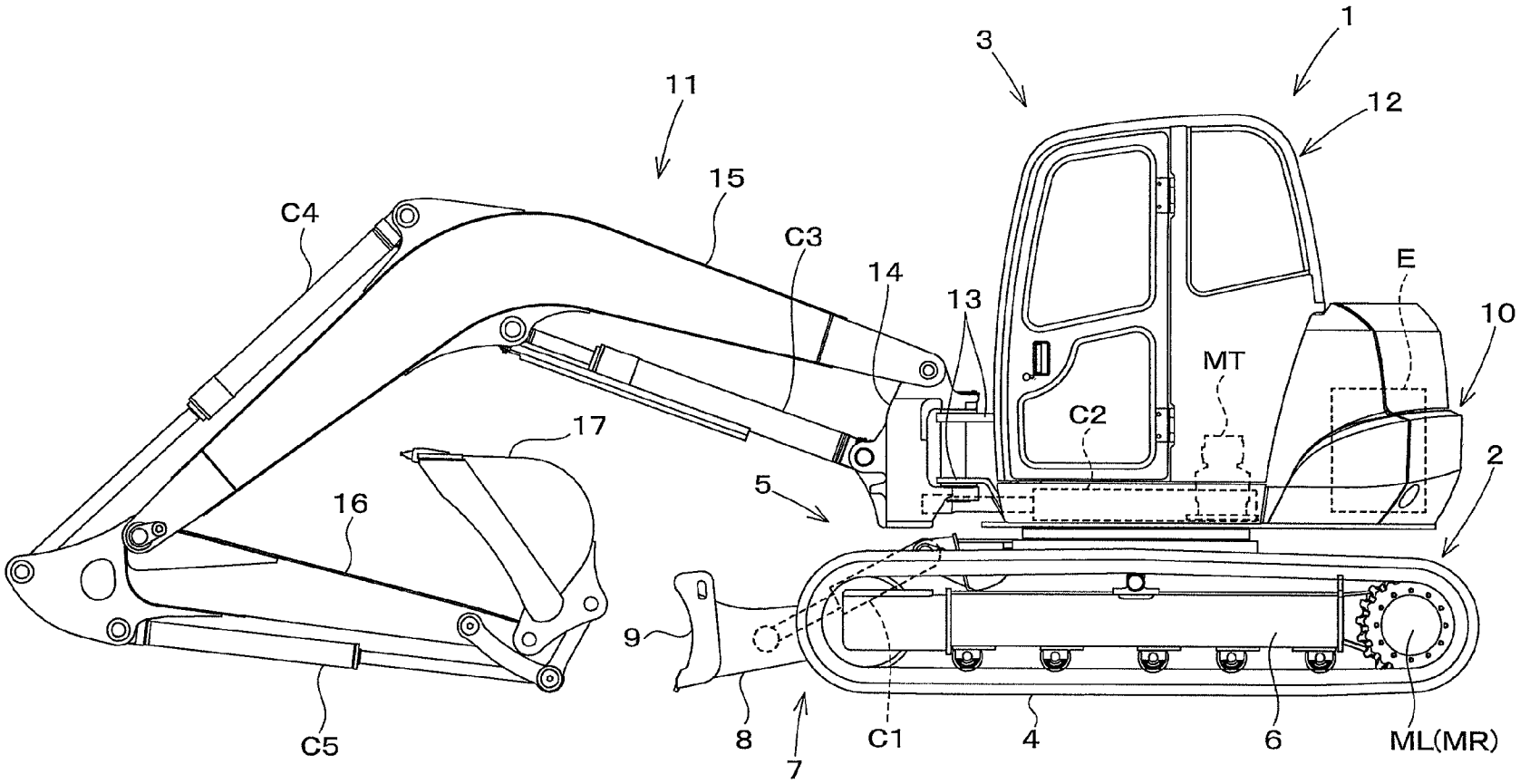
FIG. 1 is a side view of a backhoe as a whole.

FIGS. 1 to 7 show the first embodiment of the present invention. In FIG. 1, reference numeral 1 represents a backhoe (operating machine). The backhoe 1 is composed mainly of a travel body 2 constituting the lower part of the backhoe and a swivel body 3 constituting the upper part of the backhoe, which is mounted on the travel body 2 for full swivel motion about a vertical swivel axis.

In the travel body 2, on each of the right and left sides of a track frame 6 is disposed a crawler-type travel device 5 which is so designed that an endless crawler belt 4 is driven to run cyclically by a travel motor ML, MR constructed of a hydraulic motor (hydraulic actuator).

A dozer device 7 is disposed at the front of the track frame 6. The dozer device 7 is constructed by attaching a blade 9 to the front end of a support arm 8 which is, at its rear end, pivotally coupled to the track frame 6 for up-and-down rocking motion. The support arm 8 is driven to move up and down by the telescopic movement of a dozer cylinder C1 constructed of a hydraulic cylinder (hydraulic actuator).

The swivel body 3 comprises a swivel base 10 mounted on the track frame 6 for rotation about a vertical swivel axis; a front working device 11 disposed at the front of the swivel base 10; and a cabin 12 mounted on the swivel base 10.

The swivel base 10 is provided with an engine E, a radiator, a fuel tank, a hydraulic oil tank, a battery, and so forth. The swivel base 10 is driven to swivel by a swivel motor MT constructed of a hydraulic motor (hydraulic actuator).

Moreover, at the front of the swivel base 10 is disposed a support bracket 13 protruding forward from the swivel base 10. A swing bracket 14 is supported for side-to-side swing motion about a vertical axis by the support bracket 13. The swing bracket 14 is driven to swing from side to side by a swing cylinder C2 constructed of a hydraulic cylinder (hydraulic actuator).

The front working device 11 is composed mainly of a boom 15 which is, at its base part, pivotally coupled to the upper part of the swing bracket 14 for rotation about a horizontal axis so as to be able to rock up and down; an arm 16 pivotally coupled to the front end of the boom 15 for rotation about a horizontal axis so as to be able to rock back and forth; and a bucket 17 (working tool) pivotally coupled to the front end of the arm 16 for rotation about a horizontal axis so as to be able to rock back and forth.

The boom 15 is driven to rock by a boom cylinder C3 interposed between the boom 15 and the swing bracket 14. The arm 16 is driven to rock by an arm cylinder C4 interposed between the arm 16 and the boom 15. The bucket 17 is driven to rock by a bucket cylinder C5 (working cylinder) interposed between the bucket 17 and the arm 16.

The boom cylinder C3, the arm cylinder C4, and the bucket cylinder C5 are each constructed of a hydraulic cylinder (hydraulic actuator).

Moreover, in the backhoe 1, instead of the bucket 17, for example, a hydraulic attachment such as a hydraulic breaker (working tool) may be attached to the front end of the arm 16 for operation.

Next, a hydraulic system for operating the various hydraulic actuators ML, MR, MT, and C1 to C5 installed in the backhoe 1 will be explained with reference to FIGS. 2 to 7.

Figure 2:
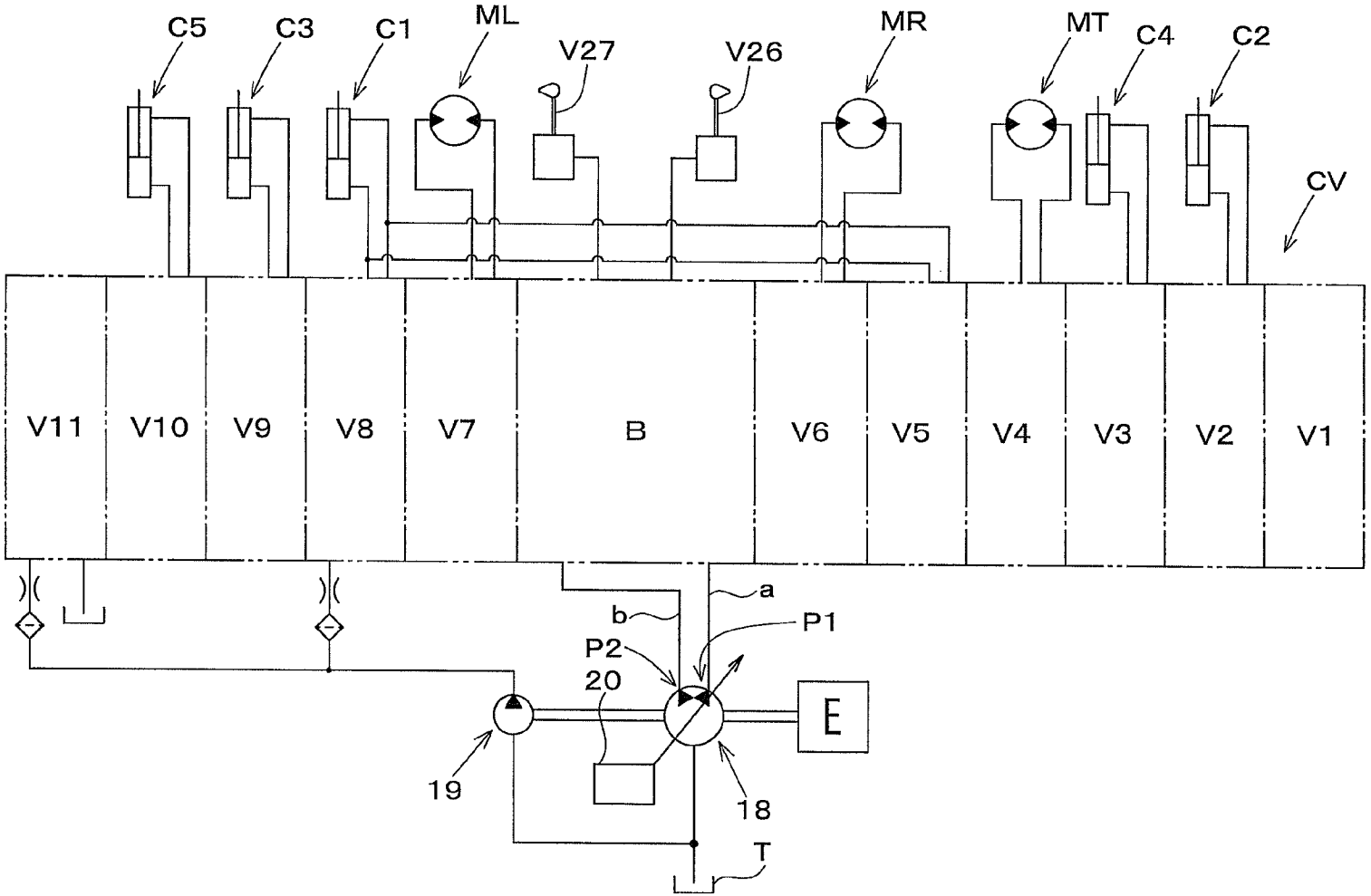
FIG. 2 is a schematic structural diagram of a hydraulic system in the first embodiment.

As shown in FIG. 2, the hydraulic system of the backhoe 1 comprises a control valve CV for controlling the hydraulic actuators ML, MR, MT, and C1 to C5; a main pump 8 for the supply of hydraulic oil to operate the hydraulic actuators ML, MR, MT, and C1 to 5; and a sub pump 19 for the supply of pressure oil for a pilot pressure and a signal such as a detection signal.

The main pump 18 and the sub pump 19 are driven by the engine E mounted in the swivel base 10.

The main pump 18 is constructed of a swash plate-type variable displacement axial pump serving as a uniform-flow double pump in which two independent discharge ports P1 and P2 are designed to discharge pressure oil in equal amounts.

More specifically, the pump adopted for use as the main pump 18 is a split-flow-type hydraulic pump having a mechanism for discharging pressure oil from a single piston-cylinder barrel kit into a discharge groove formed in the interior of a valve plate and a discharge groove formed on the exterior thereof in an alternate order.

One of the discharge ports for the discharge of pressure oil from the main pump 18, namely the discharge port P1, will be referred to as the first pressure-oil discharge port P1, whereas the other, namely the discharge port P2, will be referred to as the second pressure-oil discharge port P2.

Moreover, the hydraulic system is provided with a regulator 20 for controlling the tilting angle of the swash plate of the main pump 18.

The sub pump 19 is constructed of a fixed displacement gear pump, and a port for the discharge of pressure oil from the sub pump 19 will be referred to as the third discharge port P3.

The control valve CV is constructed by arranging control valves V1 to V11 for controlling the hydraulic actuators ML, MR, MT, and C1 to C5 and an inlet block B for receiving pressure oil successively in one direction.

In this embodiment, the control valve CV comprises a first SP control valve V1 for controlling a hydraulic attachment; a swing control valve V2 for controlling the swing cylinder C2; an arm control valve V3 for controlling the arm cylinder C4; a swivel control valve V4 for controlling the swivel motor MT; a first dozer control valve V5 for controlling the dozer cylinder C1; a right-side travel control valve V6 for controlling the travel motor MR of the right-side travel device 5; a pressure-oil receiving inlet block B; a left-side travel control valve V7 for controlling the travel motor ML of the left-side travel device 5; a second dozer control valve V8 for controlling the dozer cylinder C1; a boom control valve V9 for controlling the boom cylinder C3; a bucket control valve V10 for controlling the bucket cylinder C5; and a second SP control valve V11 for controlling other hydraulic attachment that are arranged in sequence (in right-to-left order in FIG. 2) and are coupled to one another.

As shown in FIGS. 3 to 7, the control valves V1 to V11 are each constructed by incorporating its respective direction selector valve (DV1 to DV11) and a pressure compensation valve V12 into a valve body.

The direction selector valves DV1 to DV11 serve to change the direction of pressure oil for the hydraulic actuators ML, MR, MT, and C1 to C5 that are to be placed under control. The pressure compensation valve V12 is disposed on the downstream side in the direction of pressure oil supply to the direction selector valves DV1 to DV11, yet on the upstream side in the direction of pressure oil supply to the hydraulic actuators ML, MR, MT, and C1 to C5 to be placed under control.

The direction selector valves DV1 to DV11 of the control valves V1 to V11 and the travel independent valve V13 are made up by a direct-acting spool switching valve and a pilot-operated switching valve which is pilot pressure-switchable.

Moreover, the direction selector valve (DV1 to DV11) of the control valve (V1 to V11) is so designed that a spool is moved in proportion to the range of operation of operating means for operating the direction selector valve (DV1 to DV11), and pressure oil in an amount proportional to the amount of movement of the spool is fed to the hydraulic actuators ML, MR, MT, and C1 to C5 to be placed under control (the operational speed of each of the hydraulic actuators ML, MR, MT, and C1 to C5 to be operated can be varied in proportion to the range of operation of each operating means).

Moreover, the direction selector valve DV5 of the first dozer control valve V5 and the direction selector valve DV8 of the second dozer control valve V8 are actuated concurrently by operating means such as a single dozer lever for operating the dozer device 7.

The inlet block B has built-in travel independent valve V13, PPS signal shuttle valve V14, PLS signal shuttle valve V15, travel bypass valve V16, relief valve V17, first unloading valve V18, second unloading valve V19, first restrictor V20, and second restrictor V21.

A first discharge path a is connected to the first discharge port P1 of the main pump 18, and a second discharge path b is connected to the second discharge port P2 of the main pump 18. Both of the first discharge path a and the second discharge path b are drawn into the inlet block B.

The first discharge path a extends from the inlet block B to the valve body of the right-side travel control valve V6, from there to the valve body of the first dozer control valve V5, from there to the valve body of the swivel control valve V4, from there to the valve body of the arm control valve V3, from there to the valve body of the swing control valve V2, and from there to the valve body of the first SP control valve V1, and is closed at the ending point of flow channel.

From the first discharge path a, pressure oil can be fed to each of the direction selector valves DV6, DV5, DV4, DV3, DV2, and DV1 of the right-side travel control valve V6, the first dozer control valve V5, the swivel control valve V4, the arm control valve V3, the swing control valve V2, and the first SP control valve V1, respectively, through a pressure-oil branch path f The second discharge path b extends from the inlet block B to the valve body of the left-side travel control valve V7, from there to the valve body of the second dozer control valve V8, from there to the valve body of the boom control valve V9, from there to the valve body of the bucket control valve V10, and from there to the valve body of the second SP control valve V11, and is closed at the ending point of flow channel.

From the second discharge path b, pressure oil can be fed to each of the direction selector valves DV7, DV8, DV9, DV10, DV11 of the left-side travel control valve V7, the second dozer control valve V8, the boom control valve V9, the bucket control valve V10, and the second SP control valve V11, respectively, through a pressure-oil branch path h.

A drain oil path g for returning pressure oil to the tank T is provided so as to extend from the valve body of the first SP control valve V1 to the inlet block B, and from there to the valve body of the second SP control valve V11.

The first discharge path a and the second discharge path b are connected to each other via a communication path j passing across the travel independent valve V13.

The travel independent valve V13, which is constructed of a pilot-operated switching valve which is pilot pressure-switchable, is configured to be switchable between a merging position 22 for permitting the passage of pressure oil through the communication path j and an independently feeding position 23 for blocking the passage of pressure oil through the communication path j. The travel independent valve V13 is urged in a direction to switch it to the merging position 22 by a spring.

Thus, when the travel independent valve V13 is switched to the merging position 22, pressure oil from the first discharge port P1 and pressure oil from the second discharge port P2 merge with each other, thereby enabling the supply of pressure oil to each of the direction selector valves DV1 to DV11 of the control valves V1 to V11.

On the other hand, when the travel independent valve V13 is switched to the independently feeding position 23, pressure oil from the first discharge port P1 can be fed to the direction selector valve DV6 of the right-side travel control valve V6 and the direction selector valve DV5 of the first dozer control valve V5 as well, whereas pressure oil from the second discharge port P2 can be fed to the direction selector valve DV7 of the left-side travel control valve V7 and the direction selector valve DV8 of the second dozer control valve V8 as well.

The third discharge port P3 is connected with a third discharge path m to which are connected the channel starting point of a first detection oil path r1 and the channel starting point of a second detection oil path r2.

The first detection oil path r1 extends from the third discharge path m to the direction selector valve DV8 of the second dozer control valve V8, from there to the direction selector valve DV7 of the left-side travel control valve V7, from there to the direction selector valve DV6 of the right-side travel control valve V6, and from there to the direction selector valve DV5 of the first dozer control valve V5, and is then connected to the drain oil path g.

The first detection oil path r1 is, at its point located upstream of the direction selector valve DV8 of the second dozer control valve V8, connected with the channel starting point of a first signal oil path n1. The channel ending point of the first signal oil path n1 is connected to one of pressure receivers, namely the pressure receiver 24, of the travel independent valve V13.

The second detection oil path r2 extends from the third discharge path m to the direction selector valve DV11 of the second SP control valve V11, from there to the direction selector valve DV10 of the bucket control valve V10, from there to the direction selector valve DV9 of the boom control valve V9, from there to the direction selector valve DV4 of the swivel control valve V4, from there to the direction selector valve DV3 of the arm control valve V3, from there to the direction selector valve DV2 of the swing control valve V2, and from there to the direction selector valve DV1 of the first SP control valve V1, and is then connected to the drain oil path g.

The second detection oil path r2 is, at its point located upstream of the direction selector valve DV11 of the second SP control valve V11, connected with the channel starting point of a second signal oil path n2. The channel ending point of the second signal oil path n2 is connected to the other one of the pressure receivers, namely the pressure receiver 25, of the travel independent valve V13.

With the direction selector valves DV1 to DV11 of the control valves V1 to V11 put in a condition of neutrality, the travel independent valve V13 is held in the merging position 22 under the force exerted by a spring.

When any of the direction selector valves DV6, DV7, DV5, and DV8 of the right-side travel control valve V6, the left-side travel control valve V7, the first dozer control valve V5, and the second dozer control valve V8, respectively, is operated to shift from its neutral position, then a pressure is developed in the first detection oil path r1, whereupon the travel independent valve V13 is switched from the merging position 22 to the independently feeding position 23.

That is, the travel independent valve V 13 is set in the independently feeding position 23 in each of the case of effecting only traveling motion, the case of driving the dozer device 7 alone, and the case of operating the dozer device 7 while effecting traveling motion without actuation of the front working device 11, the swivel base 10, the swing bracket 14, and the first and second SP control valves V1 and V11.

At this time, when any of the direction selector valves DV11, DV10, DV9, DV4, DV3, DV2, and DV1 of the second SP control valve V11, the bucket control valve V10, the boom control valve V9, the swivel control valve V4, the arm control valve V3, the swing control valve V2, and the first SP control valve V1, respectively, is operated to shift from its neutral position, then a pressure is developed in the second detection oil path r2, whereupon the travel independent valve V13 is switched from the independently feeding position 23 to the merging position 22.

That is, the travel independent valve V13 is set in the merging position 22 at the time of performing a combination of the operation of at least one of the right-side and left-side travel devices 5 and the dozer device 7 and the operation of at least one of the boom 15, the arm 16, the bucket 17, the swivel base 10, the swing bracket 14, and the hydraulic attachment.

Moreover, with the direction selector valves DV1 to DV11 of the control valves V1 to V11 put in a condition of neutrality, when any of the direction selector valves DV11, DV10, DV9, DV4, DV3, DV2, and DV1 of the second SP control valve V11, the bucket control valve V10, the boom control valve V9, the swivel control valve V4, the arm control valve V3, the swing control valve V2, and the first SP control valve V1, respectively, is operated to shift from its neutral position, then the travel independent valve V13 remains in the merging position 22.

Moreover, the hydraulic system is provided with an automatic idling control system (AI system) for automatically operating an accelerator of the engine E.

The AI system comprises a pressure switch 29 connected to the first signal oil path n1 (the first detection oil path r1) and the second signal oil path n2 (the second detection oil path r2) via sensor oil paths s1 and s2 and a shuttle valve V22; an electric actuator for controlling a governor of the engine E; and a controller for controlling the electric actuator. The pressure switch 29 is connected to the controller.

In the AI system, so long as the direction selector valves DV1 to DV11 of the control valves V1 to V11 are put in a condition of neutrality, a pressure is not developed in the first signal oil path n1 and the second signal oil path n2; wherefore the pressure switch 29 is not actuated in reaction to pressure. In this state, the governor is automatically controlled in a manner to effect deceleration for attaining a preset idling position by means of the electric actuator or otherwise.

Moreover, when any one of the direction selector valves DV1 to DV11 of the control valves V1 to V11 is operated, a pressure is developed in the first signal oil path n1 or the second signal oil path n2. Upon detection of the pressure, the pressure switch 29 is actuated under its own pressure sensitivity, and then the controller issues a command signal to the electric actuator and so forth. In response to the command signal, the governor is automatically controlled in a manner to effect acceleration for attaining a preset accelerating position by means of the electric actuator or otherwise.

In this embodiment, the relief valve V17 of the system is designed to be common to the first discharge path a and the second discharge path b.

More specifically, the starting point of a first relief oil path d1 is connected to the first discharge path a, and the starting point of a second relief oil path d2 is connected to the second discharge path b. The first and second relief oil paths d1 and d2 are connected to each other at their ending points. Connected to the ending points of the first and second relief oil paths d1 and d2 is an oil drain path e communicating with the tank T. The relief valve V17 is disposed on the oil drain path e.

Moreover, a check valve V23 is disposed on each of the relief oil paths d1 and d2.

It is noted that a relief valve can be disposed on each of the first discharge path a and the second discharge path b on an individual basis.

A load sensing system is adopted for use in the hydraulic system.

The load sensing system pertaining to this embodiment comprises the pressure compensation valve V12 provided in each of the control valves V1 to V11; the regulator 20 for exercising control over the swash plate of the main pump 18; the first and second unloading valves V18 and V19; the PPS signal shuttle valve V14; and the PLS signal shuttle valve V15.

Moreover, the load sensing system pertaining to this embodiment employs an after orifice-type load sensing system in which the pressure compensation valve V12 is situated on the downstream side in the direction of pressure oil supply to the direction selector valves DV1 to DV11.

In this load sensing system, when two or more of the hydraulic actuators ML, MR, MT, and C1 to C5 installed in the backhoe 1 are operated concurrently, then the pressure compensation valves V12 act to perform load adjustment for the hydraulic actuators ML, MR, MT, and C1 to C5 in a manner to cause, in the control valve (V1 to V11) at a lower load-pressure level, a pressure loss in an amount equivalent to the difference in pressure from the maximum load pressure. This makes it possible to allow pressure oil passage (distribution) through the control valve (V1 to V11) at a flow rate based on the range of operation of the spool of the control valve regardless of the magnitude of load.

Moreover, in the load sensing system, the discharge rate of the main pump 18 is controlled in accordance with the load pressure of each of the hydraulic actuators ML, MR, MT, and C1 to C5 installed in the backhoe 1, so that hydraulic power required for the load can be discharged from the main pump 18. Thereby, power saving and operability enhancement can be achieved.

The load sensing system pertaining to this embodiment will hereafter be explained in more detail.

The load sensing system comprises PPS signal transmission means for transmitting the discharge pressure of the main pump 18, in the form of PPS signal pressure, to the regulator 20; and PLS signal transmission means for transmitting, out of the load pressures of the operated control valves V1 to V11, the maximum load pressure, in the form of PLS signal pressure, to the regulator 20.

The PPS signal transmission means includes the PPS signal shuffle valve V14. The PPS signal shuttle valve V 14 has its one input port 26 connected to the first discharge path a through a first PPS input oil path k1, has its other input port 27 connected to the second discharge path b through a second PPS input oil path k2, and has its output port 28 connected to the regulator 20 through a PPS output oil path k3.

Thus, when the travel independent valve V13 is set in the merging position 22, the first discharge path a and the second discharge path b of the main pump 18 are subjected to the same pressure. The discharge pressure of the main pump 18 is transferred to the regulator 20 from the input port 26, 27 in an opened state of the PPS signal shuttle valve V14.

On the other hand, when the travel independent valve V13 is set in the independently feeding position 23, the higher one of the pressure of the first discharge path a and the pressure of the second discharge path b is transferred to the regulator 20 via the PPS signal shuttle valve V14, or, in the case where the first discharge path a and the second discharge path b of the main pump 18 are subjected to the same pressure, the discharge pressure of the main pump 18 is transferred to the regulator 20 from the input port 26, 27 in an opened state of the PPS signal shuttle valve V14.

The PLS signal transmission means includes a PLS signal transmission oil path w for transmission of the load pressure of each of the control valves V1 to V11, and the PLS signal shuttle valve V15. The PLS signal transmission oil path w extends from the valve body of the first SP control valve V1 to the valve body of the swing control valve V2, from there to the valve body of the arm control valve V3, from there to the valve body of the swivel control valve V4, from there to the valve body of the first dozer control valve V5, from there to the valve body of the right-side travel control valve V6, from there to the inlet block B, from there to the valve body of the left-side travel control valve V7, from there to the valve body of the second dozer control valve V8, from there to the valve body of the boom control valve V9, from there to the valve body of the bucket control valve V 10, and from there to the valve body of the second SP control valve V11. In each of the control valves V1 to V11, the PLS signal transmission oil path w is connected to the pressure compensation valve V12 through a load transmission oil path y.

Moreover, the PLS signal transmission oil path w passes across the travel independent valve V13 within the inlet block B. When the travel independent valve V13 is set in the independently feeding position 23, the PLS signal transmission oil path w is divided into a first line w1 extending from the travel independent valve V13 to the first SP control valve V1 and a second line w2 extending from the travel independent valve V13 to the second SP control valve V11. On the other hand, when the travel independent valve V13 is set in the merging position 22, the first line w1 and the second line w2 are connected to each other.

Moreover, the PLS signal shuttle valve V15 has its one input port 29 connected to the first line w1 through a first PLS input oil path x1, has its other input port 30 connected to the second line w2 through a second PLS input oil path x2, and has its output port 31 connected to the regulator 20 through a PLS output oil path x3.

Thus, when the travel independent valve V 13 is set in the merging position 22, out of the load pressures of the hydraulic actuators that are controlled by the control valves V1 to V11, respectively, of the control valve CV, the maximum load pressure is transferred to the regulator 20 from the input port 29, 30 in an opened state of the PLS signal shuttle valve V15.

On the other hand, when the travel independent valve V13 is set in the independently feeding position 23, the higher one of the pressure of the first line w1 and the pressure of the second line w2 is transferred to the regulator 20, or, in the case where the first line w1 and the second line w2 are subjected to the same pressure, the pressure is transferred to the regulator 20 from the input port 29, 30 in an opened state of the PLS signal shuttle valve V15.

The PPS signal shuttle valve V14 and the PLS signal shuttle valve V15 constitute a signal selection valve device VE which is capable of transmitting the highest one of the load pressures of the hydraulic actuators ML, MR, MT, and C1 to C5 of the travel device 5 and the front working device 11, namely the maximum load pressure, as well as the discharge pressure of the main pump 18, to the regulator 20 when the travel independent valve V13 is set in the merging position 22, and is also capable of transmitting the higher one of the load pressure of the travel motor MR of the right-side travel device 5 and the load pressure of the travel motor ML of the left-side travel devices 5, as well as the higher one of the discharge pressure of the first discharge port P1 and the discharge pressure of the second discharge port P2, to the regulator 20 when the travel independent valve V13 is set in the independently feeding position 23.

The first unloading valve V18 is connected to the first discharge path a through a first unloading oil path z1, and the second unloading valve V19 is connected to the second discharge path b through a second unloading oil path z2.

These first and second unloading valves V18 and V19 are urged in a direction to close them under the biasing force exerted by a spring. Moreover, the first unloading valve V18 is subjected to a force tending to relieve the pressure of the first line w1, and the second unloading valve V19 is subjected to a force tending to relieve the pressure of the second line w2.

The first restrictor V20 is connected to the first line w1, and the second restrictor V21 is connected to the second line w2.

Figure 3:
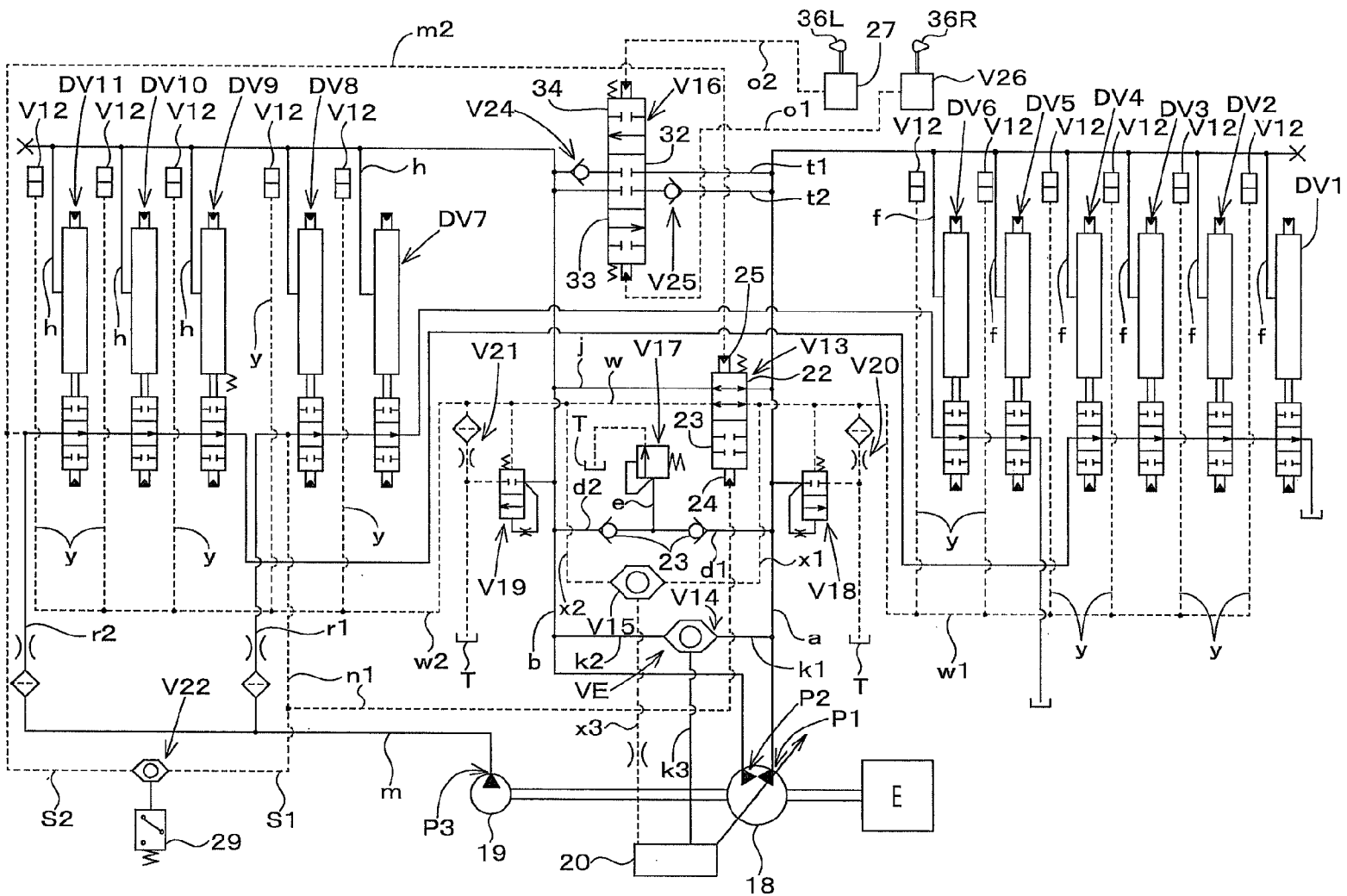
FIG. 3 is a schematic hydraulic circuit diagram of the hydraulic system in the first embodiment.
Figure 4:
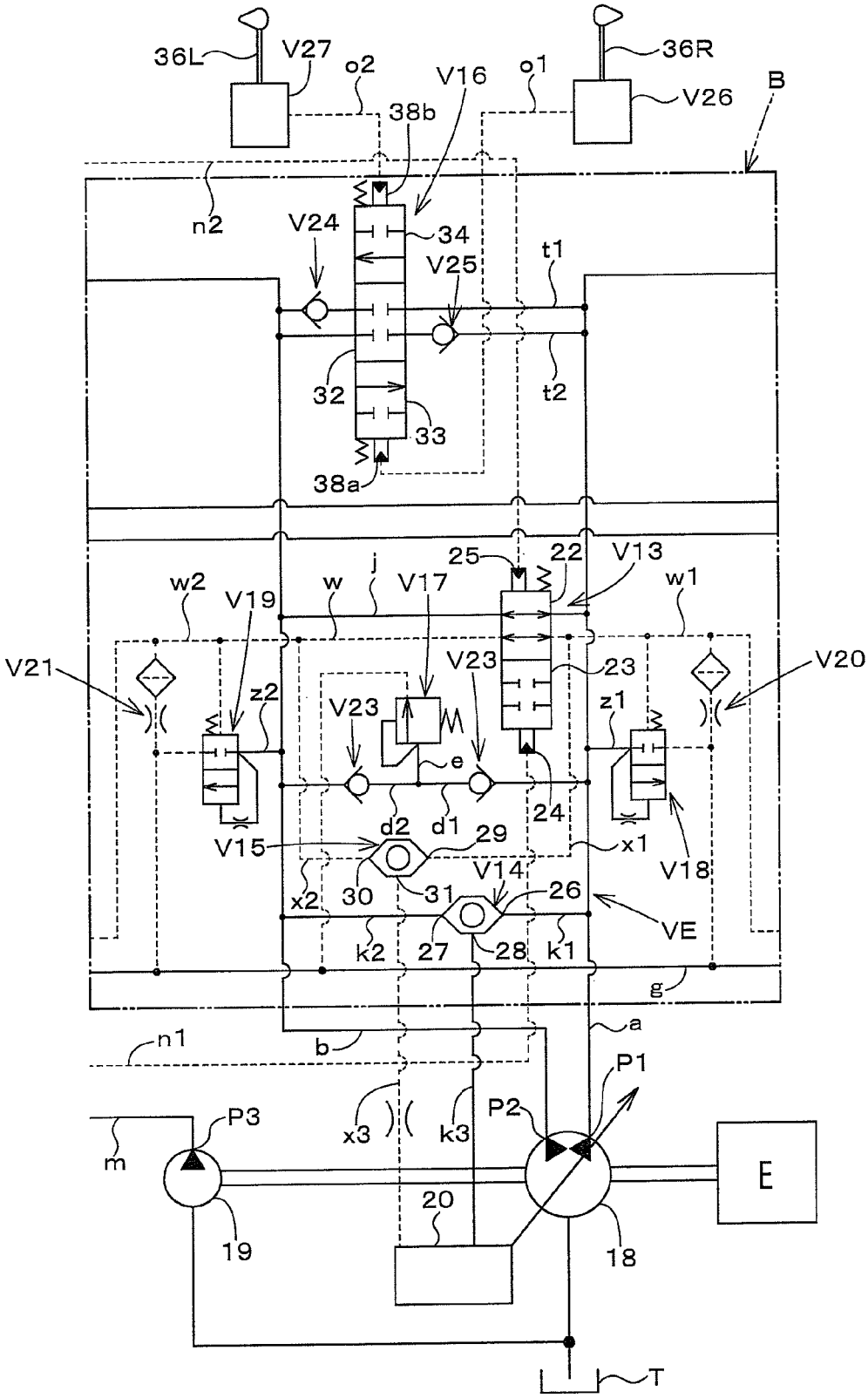
FIG. 4 is a hydraulic circuit diagram of an inlet block portion of the first embodiment.
Figure 5:
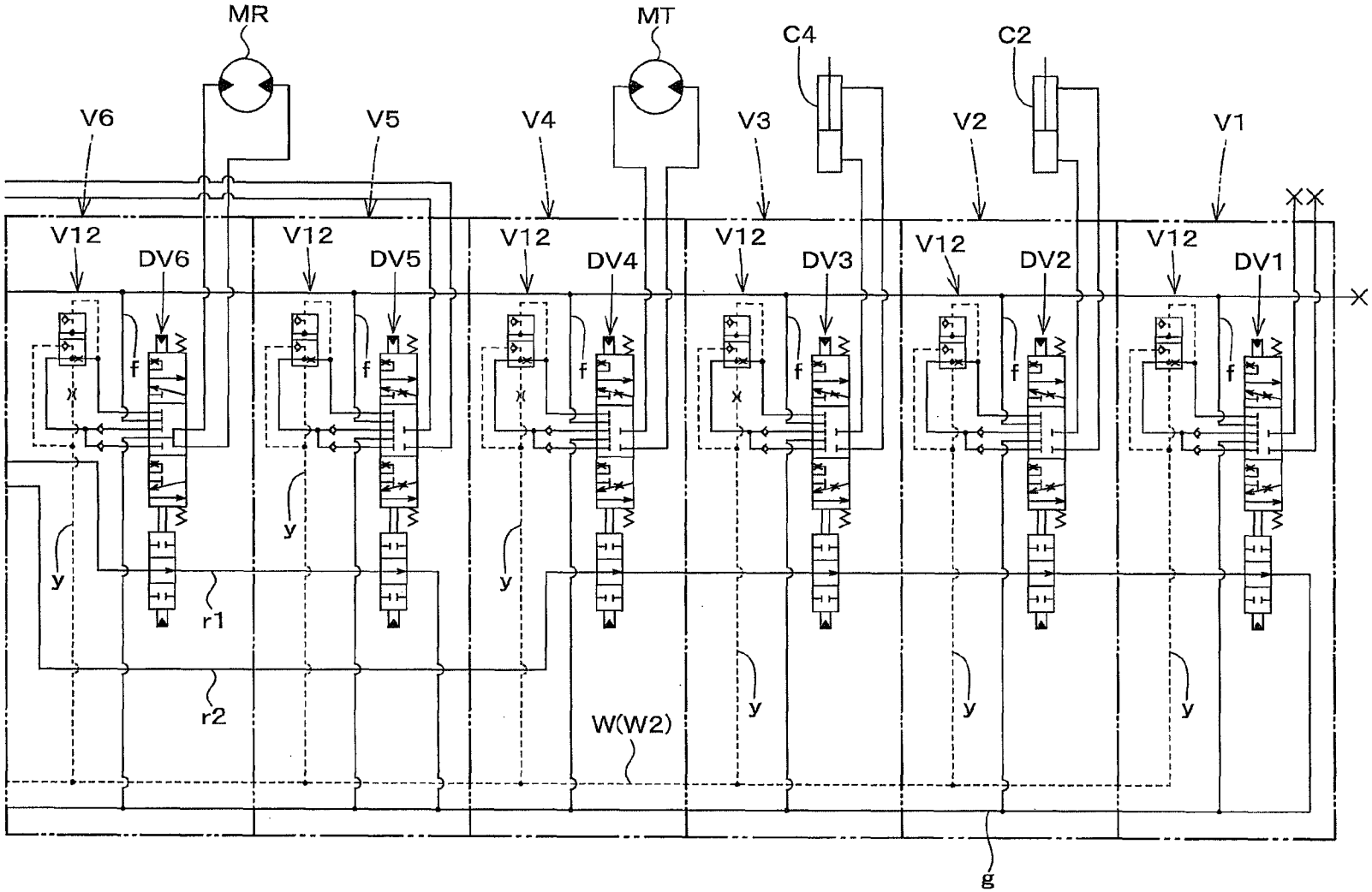
FIG. 5 is a hydraulic circuit diagram related to a right-side travel control valve, a first dozer control valve, a swivel control valve, an arm control valve, a swing control valve, and a first SP control valve of the first embodiment.
Figure 6:
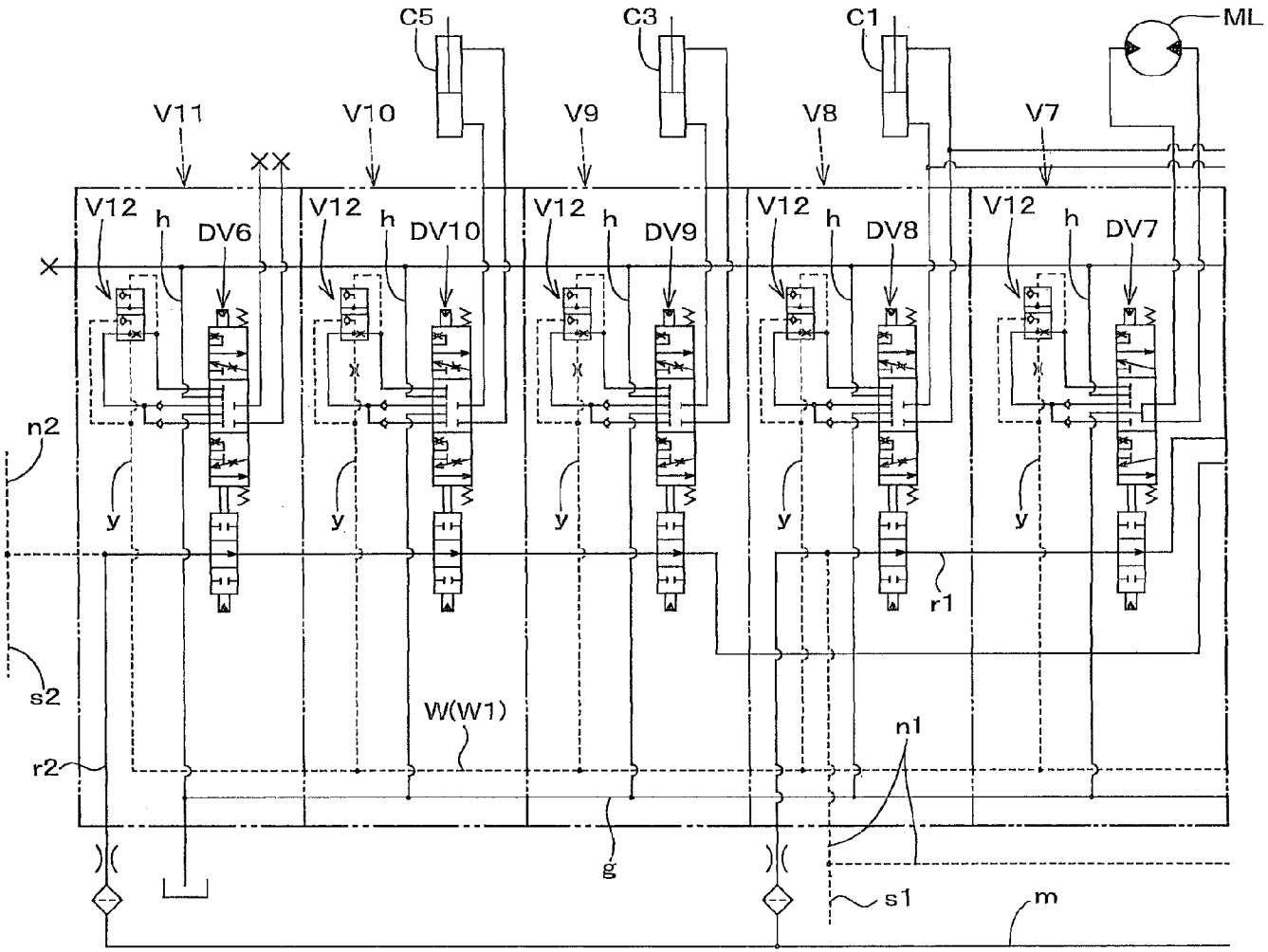
FIG. 6 is a hydraulic circuit diagram related to a left-side travel control valve, a second dozer control valve, a boom control valve, a bucket control valve, and a second SP control valve of the first embodiment.
Figure 7:
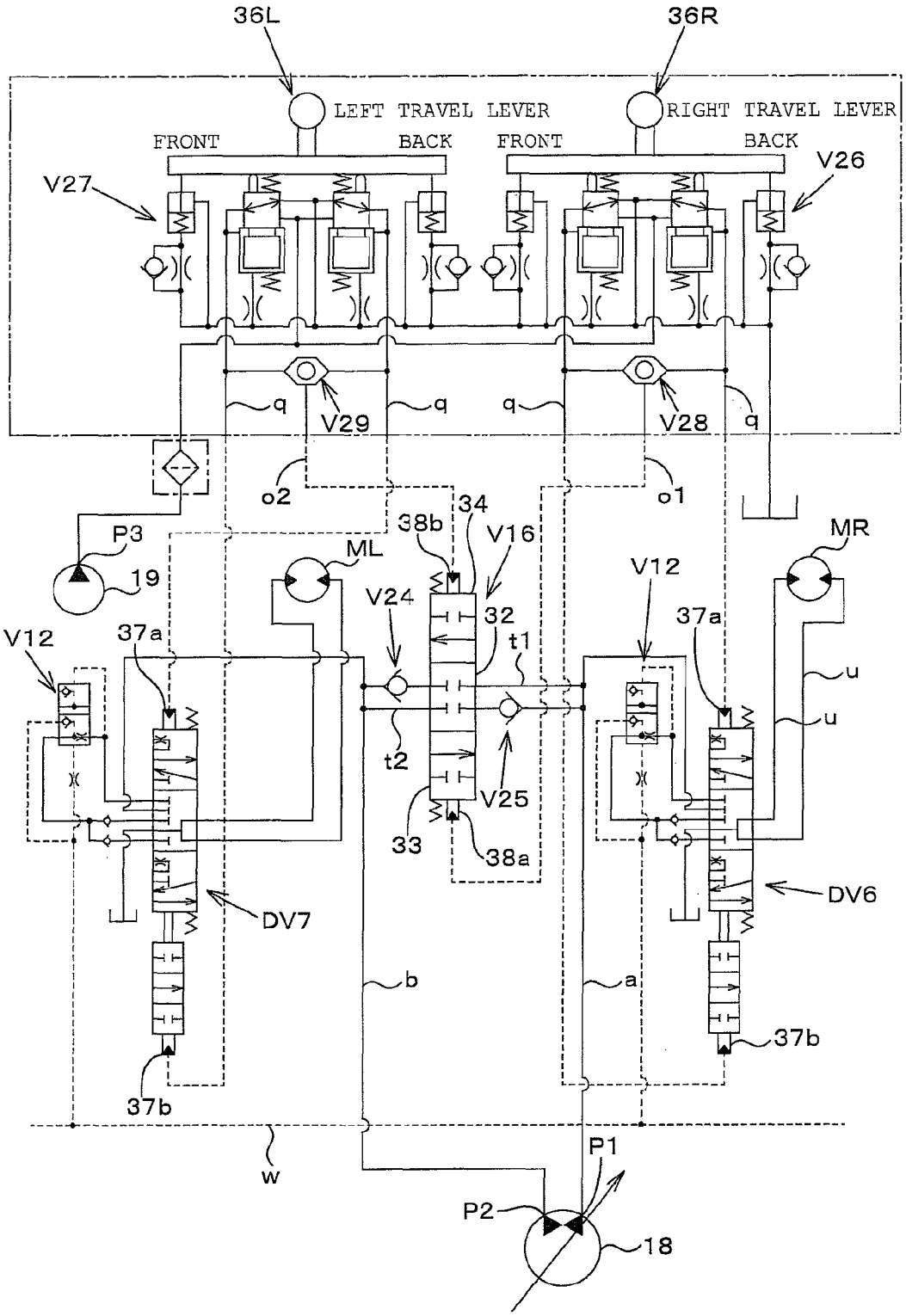
FIG. 7 is a hydraulic circuit diagram of a travel system in the first embodiment.

As shown in FIGS. 3, 4, and 7, the travel bypass valve V16 is made up by a direct-acting spool switching valve and a pilot-operated switching valve which is pilot pressure-switchable. Moreover, the travel bypass valve V16 is disposed on a first bypass oil path t1 and a second bypass oil path t2 for establishing a parallel connection of the first discharge path a and the second discharge path b. In other words, the travel bypass valve V16 is interposed between the first discharge path a and the second discharge path b in parallel relation to the travel independent valve V13.

The travel bypass valve V16 is configured to be switchable among a blocking position (neutral position) 32 for blocking the passage of pressure oil through the first bypass oil path t1 and the second bypass oil path t2, a first switching position 33 for permitting the passage of pressure oil through the first bypass oil path t1 yet blocking the passage of pressure oil through the second bypass oil path t2, and a second switching position 34 for blocking the passage of pressure oil through the first bypass oil path t1 yet permitting the passage of pressure oil through the second bypass oil path t2.

The first bypass oil path t1 is provided with a check valve V24 for preventing the flow of pressure oil from the first discharge path a to the second discharge path b, and the second bypass oil path t2 is provided with a check valve V25 for preventing the flow of pressure oil from the second discharge path b to the first discharge path a.

Moreover, the travel bypass valve V16 is held in the blocking position 32 by a spring, is switched from the blocking position 32 to the first switching position 33 by a pilot pressure outputted from a right-side travel operation valve V26 for operating the right-side travel control valve V6, and is switched from the blocking position 32 to the second switching position 34 by a pilot pressure outputted from a left-side travel operation valve V27 for operating the left-side travel control valve V7.

When a pressure difference of greater-than-predetermined level is produced between a pilot pressure from the right-side travel operation valve V26 and a pilot pressure from the left-side travel operation valve V27, then the travel bypass valve V16 is switched from the blocking position 32 to the first switching position 33 or the second switching position 34 by the higher one of those pilot pressures.

The right-side travel operation valve V26 and the left-side travel operation valve V27 are operated by a travel lever 36R and a travel lever 36L, respectively. The supply of pressure oil to each of the travel operation valves V26 and V27 is effected by the sub pump 19.

When the travel lever 36R, 36L is caused to tilt in one of forward and backward directions, the travel operation valve V26, V27 is activated in a manner whereby a pilot pressure from a command oil path q acts upon one of the pressure receivers, namely a pressure receiver 37*a*, of the direction selector valve DV6, DV7 of the travel control valve V6, V7, thereby switching the direction selector valve DV6, DV7 from its neutral position to one of its switching positions. Consequently, pressure oil is fed from one of a pair of pressure oil supply oil paths u to the travel motor ML, MR, whereas pressure oil is drained through the other one of the paired pressure oil supply oil paths u. On the other hand, when the travel lever 36R, 36L is caused to tilt in the other one of forward and backward directions, the travel operation valve V26, V27 is activated in a manner whereby a pilot pressure from the command oil path q acts upon the other one of the pressure receivers, namely a pressure receiver 37*b*, of the direction selector valve DV6, DV7 of the travel control valve V6, V7, thereby switching the direction selector valve DV6, DV7 from its neutral position to the other one of its switching positions. Consequently, pressure oil is fed from the other one of the paired supply oil paths u to the travel motor ML, MR, whereas pressure oil is drained through the one of the paired pressure oil supply oil paths u. In this way, the travel motor ML, MR is driven to run in a forward or reverse direction.

A pilot pressure from the command oil path q of the right-side travel operation valve V26 acts, through a shuttle valve V28 and a first transmission oil path o1, upon one of the pressure receivers, namely a pressure receiver 38*a*, of the travel bypass valve V16. A pilot pressure from the command oil path q of the left-side travel operation valve V27 acts, through a shuttle valve V29 and a second transmission oil path o2, upon the other one of the pressure receivers, namely a pressure receiver 38*b*, of the travel bypass valve V16.

In the hydraulic system thusly constructed, when the direction selector valves DV1 to DV11 of the control valves V1 to V11 are set in the neutral position, the travel independent valve V13 assumes the merging position 22. At this time, the first unloading oil path z1 connected to the first discharge path a is blocked by the first unloading valve V18, and the second unloading oil path z2 connected to the second discharge path b is blocked by the second unloading valve V19. Therefore, the discharge pressure of the main pump 18 (PPS signal pressure) is increased. When the difference between the PPS signal pressure and the PLS signal pressure (maintained at zero at that time) becomes greater than the controlled differential pressure, then the main pump 18 is flow-controlled in a manner to decrease the discharge rate, and the first and second unloading valves V18 and V19 are opened to drop the oil discharged from the main pump 18 into the tank T.

In this state, since the discharge pressure of the first discharge path a as well as the second discharge path b of the main pump 18 is set by the first, second unloading valve V18, V19, it follows that the discharge flow rate of the main pump 18 is reduced to a minimum.

Next, a description will be given below as to the case of operating one or more of the first SP control valve V1, the swing control valve V2, the arm control valve V3, the swivel control valve V4, the boom control valve V9, the bucket control valve V10, and the second SP control valve V11 without actuation of the travel device 5 and the dozer device 7, or the case of operating one or more of the first SP control valve V1, the swing control valve V2, the arm control valve V3, the swivel control valve V4, the boom control valve V9, the bucket control valve V10, and the second SP control valve V11, and one or more of the right-side travel control valve V6, the left-side travel control valve V7, and the first and second dozer control valves V5 and V8 simultaneously.

In this case, the travel independent valve V13 is set in the merging position 22. The pressure at the first discharge path a as well as the second discharge path b is transferred, in the form of PPS signal pressure, to the regulator 20 via the shuttle valve V14, and the maximum load pressure which is exerted on the operated hydraulic actuators ML, MR, MT, and C1 to C5 is transferred, in the form of PLS signal pressure, to the regulator 20 via the shuttle valve V15.

Then, the discharge pressure (discharge flow rate) of the main pump 18 is automatically controlled in such a manner that the PPS signal pressure minus the PLS signal pressure is defined as the controlled differential pressure (the difference between the PPS signal pressure and the PLS signal pressure is maintained as a set value).

That is, when an unloading flow rate obtained through the first, second unloading valve V18, V19 becomes zero, the discharge flow rate of the main pump 18 starts to increase. Consequently, the total amount of discharge oil from the main pump 18 flows to the operated hydraulic actuators ML, MR, MT, and C1 to C5 in accordance with the range of operation of the operated control valve (V1 to V11).

Moreover, the pressure compensation valve V12 serves to render the spools of the direction selector valves DV1 to DV11 of the operated control valves V1 to V11 uniform in respect of front-back pressure difference. Thus, regardless of the difference in magnitude among the loads exerted on the operated hydraulic actuators ML, MR, MT, and C1 to C5, respectively, the discharge flow from the main pump 18 can be split up so as to flow to each of the operated hydraulic actuators ML, MR, MT, and C1 to C5 in an amount based on the range of operation.

In the case where the flow rate required for the hydraulic actuators ML, MR, MT, and C1 to C5 exceeds the maximum discharge flow rate of the main pump 18, the discharge oil from the main pump 18 is distributed among the operated hydraulic actuators ML, MR, MT, and C1 to C5 on a proportional basis.

Moreover, in this case, even if the travel bypass valve V 16 is switched to the first switching position 33 or the second switching position 34, there arises no problem, because the discharge oil from the first discharge path a of the main pump 18 merges with the discharge oil from the second discharge path b thereof.

In the hydraulic system pertaining to this embodiment, at the time of performing a combination of the operation of the travel device 5 and the operation of the front working device 11, the travel device 5 and the front working device 11 are driven by confluent streams of oil from the first discharge path a and the second discharge path b of the main pump 18. Moreover, the main pump 18 is placed under discharge flow control during the combined operation of the travel device 5 and the front working device 11. This makes it possible to perform simultaneous operation (combined operation) of the travel device 5 and the front working device 11 with a highly-efficient system, and thereby achieve both higher operation performance capability and greater energy efficiency (fuel efficiency, heat balance) at the same time.

Moreover, even during the combined operation of the front working device 11 and the travel device 5, it never occurs that the front working device 11 slows down in motion (insufficient flow rate).

Next, a description will be given below as to the case of operating one or more of the right-side travel control valve V6, the left-side travel control valve V7, and the first and second dozer control valves V5 and V8 without actuation of the first SP control valve V1, the swing control valve V2, the arm control valve V3, the swivel control valve V4, the boom control valve V9, the bucket control valve V10, and the second SP control valve V11.

In this case, the travel independent valve V13 is switched to the independently feeding position 23, and the communication path j and the PLS signal transmission oil path w are blocked by the travel independent valve V13. Pressure oil outputted from the first discharge port P1 is caused to flow to the right-side travel control valve V6 and the first dozer control valve V5, and pressure oil outputted from the second discharge port P2 is caused to flow to the left-side travel control valve V7 and the second dozer control valve V8. Moreover, the PLS signal transmission oil path w is divided into the first line w1 and the second line w2.

Moreover, the higher one of the pressure of the first discharge path a and the pressure of the second discharge path b is transferred, as PPS signal pressure, to the regulator 20 via the shuttle valve V14 (where the first discharge path a and the second discharge path b are subjected to the same pressure, the pressure is transferred to the regulator 20 from the input port 26, 27 in an opened state of the PPS signal shuttle valve V14). Further, the higher one of the pressure of the first line w1 and the pressure of the second line w2 is transferred, as PLS signal pressure, to the regulator 20 via the shuttle valve V15 (where the first line w1 and the second line w2 are subjected to the same pressure, the pressure is transferred to the regulator 20 from the input port 29, 30 in an opened state of the PLS signal shuttle valve V15).

Also in this case, the discharge pressure (discharge flow rate) of the main pump 18 is automatically controlled in such a manner that the PPS signal pressure minus the PLS signal pressure is defined as the controlled differential pressure (the difference between the PPS signal pressure and the PLS signal pressure is maintained as a set value).

In the hydraulic system pertaining to this embodiment, since the first dozer control valve V5 and the second dozer control valve V8 serve to draw equal amounts of pressure oil from the first discharge path a and the second discharge path b and deliver the oil to the dozer cylinder C1, it is possible to ensure the straight-ahead travel capability of the backhoe 1. In addition, since the main pump 18 is flow-controlled in accordance with the range of operation of the control valve V5, V6, V7, V8, it is possible to achieve energy saving.

Moreover, in the case of driving the backhoe 1 to turn to the right or left, under the split-flow control exercised by the pressure compensation valve V12, the travel motors ML and MR are subjected to a high load. Therefore, even if the load applied to the dozer cylinder C1 is low, it never occurs that pressure oil flows to the dozer cylinder C1 at a flow rate greater than the predetermined value. This makes it possible to maintain an independent circuit configuration for exercising independent supply control, and more specifically effecting the supply of pressure oil from the first discharge port P1 to the right-side travel control valve V6 and the supply of pressure oil from the second discharge port P2 to the left-side travel control valve V7 on an individual basis. In addition, it is possible to draw equal amounts of pressure oil from the first discharge port P1 and the second discharge port P2. Accordingly, an adequate flow rate for the supply of pressure oil to the travel motors ML and MR can be secured, with the consequent attainment of high turning performance capability.

Moreover, under the above-stated circumstance, during traveling on the flat ground, in the case of making a turn to the left for example, the right-side travel control valve V6 is so operated as to rev up the hydraulic motor MR of the right-side travel device 5. Then, the hydraulic motor MR of the right-side travel device 5 becomes higher in load pressure than the hydraulic motor of the left-side travel device, and also the hydraulic oil fed to the hydraulic motor MR of the right-side travel device 5 becomes higher in pressure than that fed to the hydraulic motor of the left-side travel device. Thus, the load pressure (PLS signal pressure) of the hydraulic motor MR of the right-side travel device 5 is transferred to the regulator 20 via the PLS signal shuttle valve V15, and also the pressure (PPS signal pressure) of the first discharge path a which is fed to the hydraulic motor MR of the right-side travel device 5 is transferred to the regulator 20. On the basis of the PLS signal pressure and the PPS signal pressure, the discharge flow rate of the main pump 18 is controlled in a manner to make a turn to the left successfully (on the other hand, in the case of making a turn to the right, the load pressure of the left-side hydraulic motor ML is transferred to the regulator 20 via the PLS signal shuttle valve V15, and also the pressure of the second discharge path b which is fed to the left-side hydraulic motor ML is transferred to the regulator 20. On the basis of the PLS signal pressure and the PPS signal pressure, the discharge flow rate of the main pump 18 is controlled in a manner to make a turn to the right successfully).

However, during forward downhill travel, in the case of making a turn to the left for example, although the right-side travel control valve V6 is so operated as to rev up the hydraulic motor MR of the right-side travel device 5, on a downhill run, the backhoe 1 is propelled in the running direction under its own weight. Consequently, no load pressure is developed in the hydraulic motor MR of the right-side travel device 5.

Meanwhile, since the pressure of the second discharge path b which is fed to the left-side travel control valve V7 rises to an unloading pressure level, it follows that the pressure of the second discharge path b which is transferred to the left-side travel control valve V7 is transferred, as PPS signal pressure, to the regulator 20.

In the absence of load pressure in the hydraulic motor MR of the right-side travel device 5, a surplus arises in the pressure difference between the PLS signal pressure and the PPS signal pressure, in consequence whereof there results no increase in the discharge flow rate of the main pump 18. After all, the backhoe becomes unable to make a turn.

In this regard, according to this embodiment, in that case, since a pilot pressure outputted from the right-side travel operation valve V26 is higher than a pilot pressure outputted from the left-side travel operation valve V27, it follows that the travel bypass valve V16 is switched to the first switching position 33, whereupon discharge oil from the second discharge port P2 is caused to flow from the second discharge path b to the first discharge path a through the first bypass oil path t1 (in the case of making a turn to the right, the travel bypass valve V16 is switched to the second switching position 34, whereupon discharge oil from the first discharge port P1 is caused to flow from the first discharge path a to the second discharge path b through the second bypass oil path t2).

In this way, the pressure-oil supply system for the hydraulic motor MR of the right-side travel device 5 can be maintained at a high-pressure level, and thus the main pump 18 can be flow-controlled properly on the basis of the PLS signal pressure and the PPS signal pressure from the right-side travel device. This allows the backhoe to make a turn successfully even on a downhill run.

Also, there is no problem with a turn on the flat ground. That is, in the case of making a turn to the left on the flat ground, even if the travel bypass valve V16 is switched to the first switching position 33, by virtue of the check valve V24, pressure oil can be restrained from flowing from the first discharge path a to the second discharge path b through the first bypass oil path t1 (in the case of making a turn to the right on the flat ground, even if the travel bypass valve V16 is switched to the second switching position 34, pressure oil can be restrained from flowing from the second discharge path b to the first discharge path a through the second bypass oil path t2).

Moreover, in the case where a pilot pressure from the right-side travel operation valve V26 and a pilot pressure from the left-side travel operation valve V27 stand at the same pressure level, the travel bypass valve V16 is set in the blocking position 32. That is, since there is no flow of pressure oil between the first discharge path a and the second discharge path b, it is possible to ensure the straight-ahead travel capability.

Figure 8:
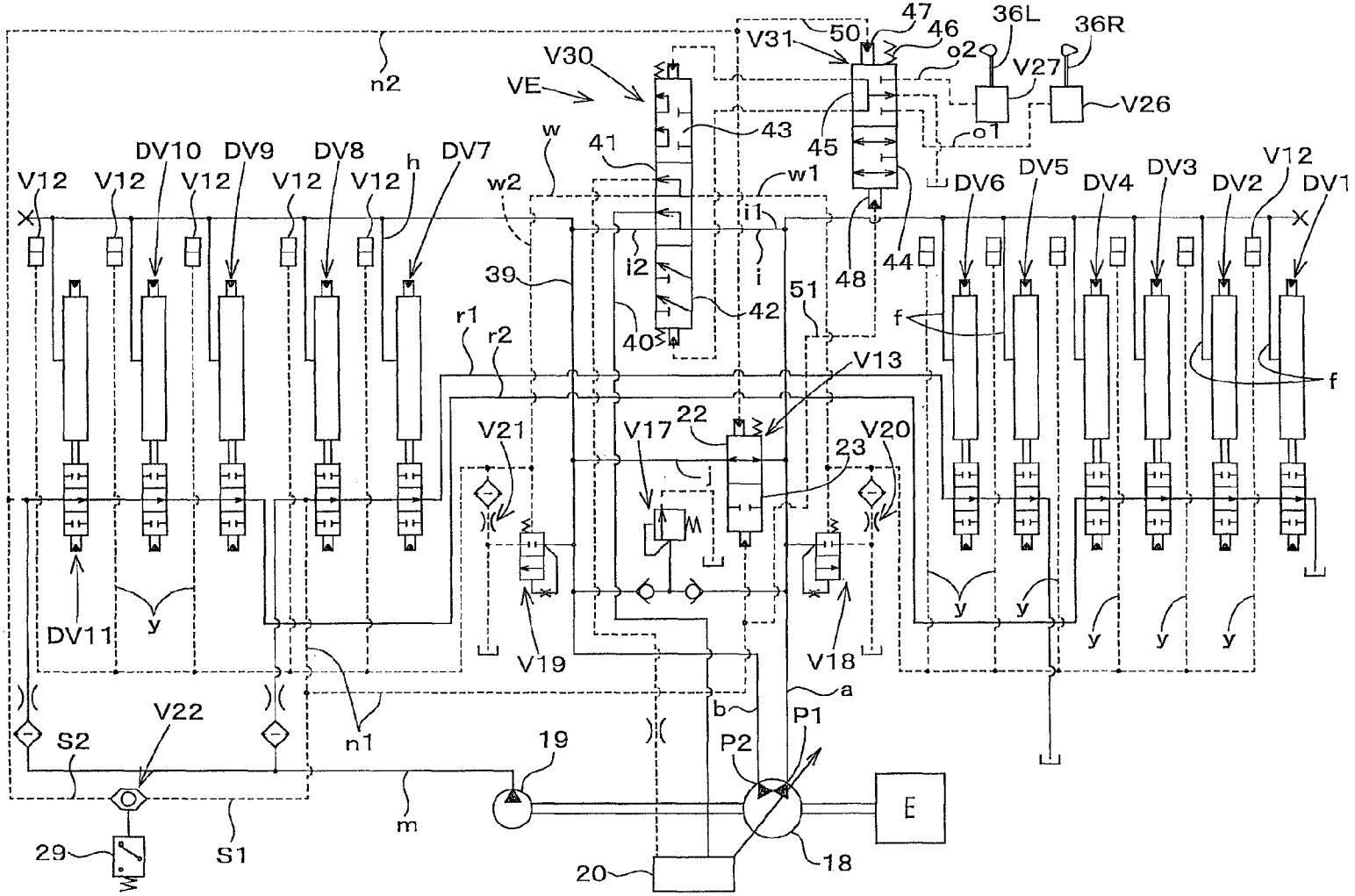
FIG. 8 is a schematic hydraulic circuit diagram of the hydraulic system in a second embodiment.
Figure 9:
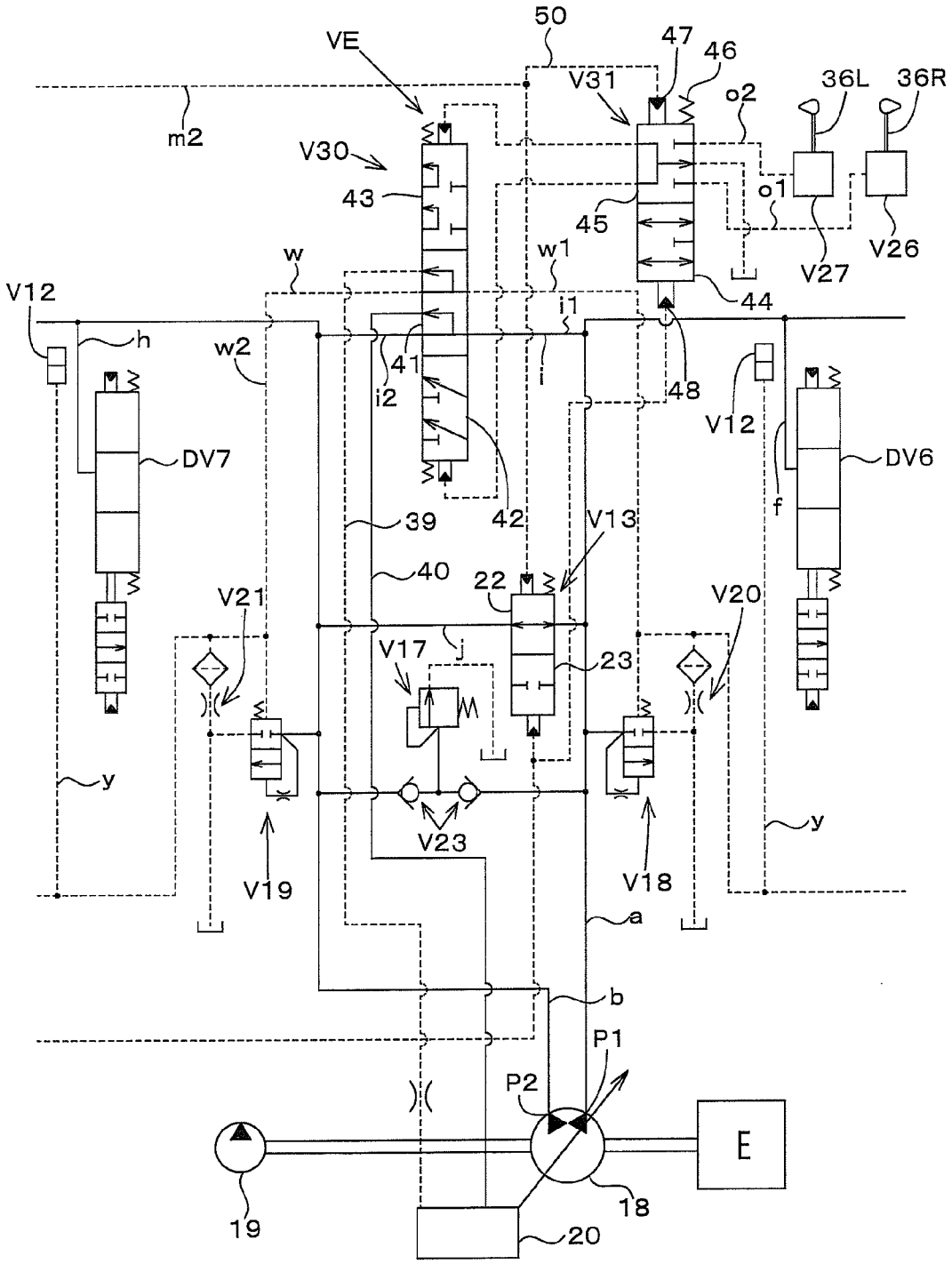
FIG. 9 is a hydraulic circuit diagram of the principal part of the second embodiment.

FIGS. 8 and 9 show the hydraulic system in accordance with the second embodiment.

Where a major difference between the hydraulic system pertaining to the second embodiment and that of the first embodiment, in contrast to the first embodiment in which the signal selection valve device VE is composed of the PPS signal shuttle valve V14 and the PLS signal shuttle valve V15 (as a feature of the circuit configuration, the shuttle valves V14 and V15 are adopted for the transmission of PPS signal pressure and PLS signal pressure to the regulator 20), in the second embodiment, the signal selection valve device VE is composed of a signal selection valve V30 and a deselecting valve V31 constructed of a direct-acting spool switching valve which is pilot pressure-switchable.

Moreover, the PLS signal transmission oil path w is disposed so as not to pass across the travel independent valve V13 but to pass across the signal selection valve V30. Further, there is provided a coupling oil path i which is so disposed as to pass across the signal selection valve V30 and establishes the coupling between the first discharge path a and the second discharge path b.

The signal selection valve V30 is connected to the regulator 20 via a PLS transmission line 39 and a PPS transmission line 40.

The signal selection valve V30 is configured to be switchable among three positions, namely a neutral position 41, a first switching position 42, and a second switching position 43.

When the signal selection valve V30 is set in the neutral position 41, the load pressure of the hydraulic actuator which is operated by the control valve (V1 to V11) is transferred from the PLS signal transmission oil path w to the regulator 20 through the PLS transmission line 39, and also the pressure of the coupling oil path i (discharge pressure of the main pump 18) is transferred to the regulator 20 through the PPS transmission line 40.

On the other hand, when the signal selection valve V30 is set in the first switching position 42 or the second switching position 43, the PLS signal transmission oil path w is divided into a first line w1 extending from the signal selection valve V30 to the first SP control valve V1, and a second line w2 extending from the signal selection valve V30 to the second SP control valve 11. In addition, the coupling oil path i is divided into a first oil path i1 connected to the first discharge path a, and a second oil path i2 connected to the second discharge path b. That is, with the signal selection valve in its neutral position 41, the first line w1 and the second line w2 are connected to each other, and the first oil path i1 and the second oil path i2 are connected to each other.

Moreover, with the signal selection valve in its first switching position 42, the first line w1 communicates with the PLS transmission line 39, so that the load pressure of the first line w1 can be transferred, through the PLS transmission line 39, to the regulator 20, and also the first oil path i1 communicates with the PPS transmission line 40, so that the load pressure of the first discharge path a can be transferred, through the first oil path i1 and the PPS transmission line 40, to the regulator 20.

Further, with the signal selection valve in its second switching position 43, the second line w2 communicates with the PLS transmission line 39, so that the load pressure of the second line w2 can be transferred, through the PLS transmission line 39, to the regulator 20, and also the second oil path i2 communicates with the PPS transmission line 40, so that the load pressure of the second discharge path b can be transferred, through the second oil path i2 and the PPS transmission line 40, to the regulator 20.

The signal selection valve V30 can be held in the neutral position 41 under the biasing force exerted by a spring. Moreover, the signal selection valve V30 can be switched from the neutral position 41 to the first switching position 42 by a pilot pressure outputted through the first transmission oil path o1 from the right-side travel operation valve V26, and can be switched from the neutral position 41 to the second switching position 43 by a pilot pressure outputted through the second transmission oil path o2 from the left-side travel operation valve V27.

The deselecting valve V31 is configured to be switchable between two positions, namely an active position 44 and an inactive position 45. When in its active position 44, the deselecting valve V31 serves to allow a pilot pressure outputted from the right-side travel operation valve V26 as well as the left-side travel operation valve V27 to act upon the signal selection valve V30. On the other hand, when in its inactive position 45, the deselecting valve V31 serves to restrain a pilot pressure outputted from the right-side travel operation valve V26 as well as the left-side travel operation valve V27 from acting upon the signal selection valve V30.

The deselecting valve V31 is urged in a direction to switch it to the inactive position 45 by a spring 46.

Moreover, a pilot pressure from the second signal oil path n2 acts, through a transmission line 50, upon one of the pressure receivers, namely a pressure receiver 47 formed with the spring 46, and also a pilot pressure from the first signal oil path n1 acts, through a transmission line 51, upon the other one of the pressure receivers, namely a pressure receiver 48 opposite to the pressure receiver 47.

Accordingly, the deselecting valve V31 assumes the inactive position 45 when the travel independent valve V13 is set in the merging position 22, and assumes the active position 44 when the travel independent valve V13 is set in the independently feeding position 23.

Otherwise, the second embodiment is similar in structure to the first embodiment.

In the second embodiment, the travel independent valve V13 is set in the independently feeding position 23 and also the deselecting valve V31 is switched to the active position 44 for each of the case of driving the travel device 5 alone, the case of driving the dozer device 7 alone, and the case of driving the travel device 5 and the dozer device 7 without actuation of the front working device 11, the swivel base 10, the swing bracket 14, and the hydraulic attachments to be operated by the first and second SP control valves V1 and V11.

In the case of driving the travel device 5 alone, when there is a pressure difference of greater-than-predetermined level between a pilot pressure from the right-side travel operation valve V26 and a pilot pressure from the left-side travel operation valve V27, then the signal selection valve V30 is switched to the first switching position 42 or the second switching position 43 by the higher one of those pilot pressures.

For example, in the case of making a turn to the left, the signal selection valve V30 is switched to the first switching position 42 by a pilot pressure from the right-side travel operation valve V26. Then, the pressure of the first discharge path a is transferred to the regulator 20 through the PPS transmission line 40, and also the load pressure of the right-side travel motor MR is transferred to the regulator 20 through the PLS transmission line 39. On the basis of them, discharge flow control is exercised over the main pump 18.

On the other hand, in the case of making a turn to the right, the signal selection valve V30 is switched to the second switching position 43 by a pilot pressure from the left-side travel operation valve V27. Then, the pressure of the second discharge path b is transferred to the regulator 20 through the PPS transmission line 40, and also the load pressure of the left-side travel motor ML is transferred to the regulator 20 through the PLS transmission line 39. On the basis of them, discharge flow control is exercised over the main pump 18.

Moreover, in the case of driving the travel device 5 alone for straight-ahead travel, since a pilot pressure from the right-side travel operation valve V26 and a pilot pressure from the left-side travel operation valve V27 stand at the same pressure level, it follows that the signal selection valve V30 is set in the neutral position 41. Thus, the discharge pressure of the first, second discharge port P1, P2 of the main pump 18 is transferred to the regulator 20 through the PPS transmission line 40, and also the load pressure of the left-side, right-side travel motor ML, MR is transferred to the regulator 20 through the PLS transmission line 39. On the basis of them, discharge flow control is exercised over the main pump 18.

As has already been described, in the case of making a turn to the right or left, the pump discharge pressure and the motor load pressure for one of the travel devices 5 that is controlled by, out of the travel operation valves V26 and V27, the one which bears a higher pilot pressure (the higher one of a pilot pressure from the right-side travel operation valve V26 and a pilot pressure from the left-side travel operation valve V27) are selected as PPS signal pressure and PLS signal pressure. Accordingly, the hydraulic system pertaining to the second embodiment is free from the problem with a turn on a forward downhill run as has been described in the chapter presenting the first embodiment.

Moreover, the operation for the case of driving the travel device 5 and the dozer device 7 is basically the same as that for the case of driving the travel device 5 alone thus far described, except that, in the former, when making a turn to the left, the higher one of the load pressure of the right-side travel motor MR and the load pressure of the dozer cylinder C1 is transferred to the regulator 20; when making a turn to the right, the higher one of the load pressure of the left-side travel motor ML and the load pressure of the dozer cylinder C1 is transferred to the regulator 20; and, when effecting straight-ahead travel, the higher one of the load pressure of the left-side, right-side travel motor ML, MR and the load pressure of the dozer cylinder C1 is transferred to the regulator 20.

Further, in the case of driving the dozer device 7 alone, the signal selection valve V30 is set in the neutral position 41. Thus, discharge flow control is exercised over the main pump 18 under the discharge pressure of the first, second discharge port P1, P2 of the main pump 18 and the load pressure of the dozer cylinder C1.

Next, a description will be given below as to the case of operating one or more of the first SP control valve V1, the swing control valve V2, the arm control valve V3, the swivel control valve V4, the boom control valve V9, the bucket control valve V10, and the second SP control valve V11 without actuation of the travel device 5 and the dozer device 7, or the case of operating one or more of the first SP control valve V1, the swing control valve V2, the arm control valve V3, the swivel control valve V4, the boom control valve V9, the bucket control valve V10, and the second SP control valve V11, and one or more of the right-side travel control valve V6, the left-side travel control valve V7, and the first and second dozer control valves V5 and V8 simultaneously.

In this case, the travel independent valve V13 is set in the merging position 22, and also the deselecting valve V31 is set in the inactive position 45 and the signal selection valve V30 is set in the neutral position 41.

Then, the maximum load pressure, namely the highest one of the load pressures of the hydraulic actuators that are operated by the control valves V1 to V11 is transferred from the PLS signal transmission oil path w to the regulator 20 through the PLS transmission line 39, and also the pressure of the first, second discharge port of the main pump 18 is transferred from the coupling oil path i to the regulator 20 through the PPS transmission line 40. On the basis of them, discharge flow control is exercised over the main pump 18.

In the hydraulic system pertaining to the first embodiment, as a feature of the circuit configuration, the shuttle valves V14 and V15 are adopted for the transmission of PPS signal pressure and PLS signal pressure to the regulator 20. That is, in contrast to the second embodiment, the circuit configuration of the load sensing system can be simplified, thus permitting reduction in production cost.

It is noted that, in each of the embodiments, the arrangement of the control valves V1 to V11 is not limited to that illustrated in the drawings. Insofar as one of the right-side travel control valve V6 and the left-side travel control valve V7 is provided in one of the pressure-oil supply systems of, respectively, the two independent discharge ports P1 and P2, and the other one of the right-side travel control valve V6 and the left-side travel control valve V7 is provided in the other one of the pressure-oil supply systems, there is no particular limitation to how the others, namely the control valves V1, V2, V3, V4, V5, and V8 to V11, are to be arranged.

In addition, there is no particular limitation to the order of arrangement of the control valves V1 to V11.

The invention claimed is:

1. An operating machine comprising:

right-side and left-side travel devices;

a hydraulic actuator for driving the left-side travel device;

a hydraulic actuator for driving the right-side travel device;

a front working device;

a hydraulic actuator for driving the front working device;

a variable displacement hydraulic pump for discharging pressure oil to be fed to each of the hydraulic actuators, the variable displacement hydraulic pump being a split-flow-type and having a first discharge port P1 and a second discharge port P2 both for discharging the pressure oil to each of the hydraulic actuators; and a travel independent valve configured to be switchable between:

a merging position for merging the pressure oil from the first discharge port P1 of the hydraulic pump with the pressure oil from the second discharge port P2 of the hydraulic pump to effect the supply of the pressure oil to the hydraulic actuators; and an independently feeding position for independently effecting the supply of the pressure oil from the first discharge port P1 of the hydraulic pump to the hydraulic actuator of the right-side travel device and the supply of the pressure oil from the second discharge port P2 to the hydraulic actuator of the left-side travel device, the travel independent valve being switched to the merging position in a case of driving the front working device without actuation of either of the right-side or the left-side travel devices, or a case of driving each of the right-side and the left-side travel devices and the front working device concurrently, or being switched to the independently feeding position in a case of driving each of the right-side and the left-side travel devices without actuation of the front working device;

a load sensing system adapted to control a discharge flow rate of the variable displacement hydraulic pump based on a pressure difference between:

a discharge pressure of the split-flow-type variable displacement hydraulic pump; and a maximum load pressure that is a highest one of load pressures of the hydraulic actuators of the right-side and left-side travel devices and the front working device in any one of a case where the travel independent valve is in the merging position and in a case where the travel independent valve is in the independently feeding position.

2. The operating machine as set forth in claim 1, wherein the variable displacement hydraulic pump has a swash plate;

the load pressure includes: a first pressure that is a pressure acting on the hydraulic actuator for driving the right-side travel device, and a second pressure that is a pressure acting on the hydraulic actuator for driving the left-side travel device;

the discharge pressure of the variable displacement hydraulic pump includes: a first discharge pressure that is a pressure of the discharging from the first discharge port P1, and a second discharge pressure that is a pressure of the discharging from the second discharge port P2;

the load sensing system has a regulator for controlling the swash plate; and a signal selection valve device for transmitting a pressure to the regulator, the signal selection valve being capable of transmitting to the regulator, a higher one of the first pressure and the second pressure, and a higher one of the first discharge pressure and the second discharge pressure when the travel independent valve is set in the independently feeding position.

3. The operating machine as set forth in claim 2, wherein the load sensing system includes:

a first discharge path for allowing passage of the pressure oil discharged from the first discharge port P1, a second discharge path for allowing passage of the pressure oil discharged from the second discharge port P2, and a signal transmission oil path w;

signal transmission oil path w has a first line for transmission of the first pressure, and a second line for transmission of the second pressure;

the first line and the second line communicate with each other when the travel independent valve is in the merging position, thereby enabling transmission of the maximum load pressure, and blocking communication when the travel independent valve is in the independently feeding position; and the signal selection valve has a first signal shuttle valve V14 and a second signal shuttle valve V15;

the first signal shuttle valve V14 and the second signal shuttle valve V15 having two input ports and one output port to output a pressure inputted for the input ports and outputting a higher one of the pressure inputted from the one input port and the pressure inputted from the other input port;

one input port of the first shuttle valve V14 is connected to the first discharge path, the other input port of the first shuttle valve V14 is connected to the second discharge path;

the output port of the first signal shuttle valve V14 is connected to the regulator;

the one input port of the second signal shuttle valve V15 is connected to the first line;

the other input port of the second shuttle valve V15 is connected to the second line; and the output port of the second shuttle valve V15 is connected to the regulator.

4. The operating machine as set forth in claim 3, wherein the loading sensing system includes:

a right-side travel control valve for controlling the hydraulic actuator of the right-side travel device; a right-side travel operation valve for operating the right-side travel control valve by a pilot pressure;

a left-side travel control valve for controlling the hydraulic actuator of the left-side travel device;

a left-side travel operation valve for operating the left-side travel control valve by a pilot pressure; and a travel bypass valve switchable between:

a blocking position for blocking a flow of the pressure oil between the first discharge path and the second discharge path, a first switching position for permitting a one-way flow of the pressure oil from the second discharge path to the first discharge path, and a second switching position for permitting a one-way flow of the pressure oil from the first discharge path to the second discharge path, wherein a pilot pressure outputted from the right-side travel operation valve acts in a direction to switch the travel bypass valve from the blocking position to the first switching position;

a pilot pressure outputted from the left-side travel operation valve acts in a direction to switch the travel bypass valve from the blocking position to the second switching position; and when a pressure difference greater than a predetermined level is produced between a pilot pressure outputted from the right-side travel operation valve and a pilot pressure outputted from the left-side travel operation valve, then the travel bypass valve is switched from the blocking position to the first switching position or the second switching position by a higher one of the pilot pressure outputted from the right-side travel operations valve and the pilot pressure outputted from the left-side travel operation valve.

5. The operating machine as set forth in claim 2, further comprising:

a coupling oil path i for establishing coupling between the first discharge path for allowing passage of pressure oil from the first discharge port P1 and the second discharge path for allowing passage of pressure oil from the second discharge port P2;

signal transmission oil path w for permitting transmission of the maximum load pressure of the load pressures of the hydraulic actuators;

a right-side travel operation valve for operating, by a pilot pressure, the right-side travel control valve for controlling the right-side travel device and a left-side travel operation valve for operating, by a pilot pressure, the left-side travel control valve for controlling the left-side travel device, wherein the signal selection valve device is composed of:

a signal selection valve constructed of a switching valve configured to be switchable among a neutral position, a first switching position, and a second switching position; and a deselecting valve configured to be switchable between an active position and an inactive position, the signal selection valve, being disposed on the coupling oil path i as well as the signal transmission oil path w, allowing transmission of the pressure of the coupling oil path i as well as the pressure of the signal transmission oil path w to the regulator when set in the neutral position, effecting division of the coupling oil path i as well as the signal transmission oil path w for transmission of the discharge pressure of the first discharge path and the load pressure of the hydraulic actuator of the right-side travel device to the regulator when set in the first switching position, and effecting division of the coupling oil path i as well as the signal transmission oil path w for transmission of the discharge pressure of the second discharge path and the load pressure of the hydraulic actuator of the left-side travel device to the regulator when set in the second switching position, the deselecting valve causing a pilot pressure from the right-side travel operation valve to act in a direction to switch the signal selection valve from the neutral position to the first switching position and also causing a pilot pressure from the left-side travel operation valve to act in a direction to switch the signal selection valve from the neutral position to the second switching position when set in the active position, and preventing the pilot pressure from the right-side travel operation valve as well as the pilot pressure from the left-side travel operation valve from acting upon the signal selection valve to bring the signal selection valve into the neutral position when set in the inactive position.

6. The operating machine as set forth in claim 5, wherein the deselecting valve is switched to the active position by the pilot pressure for switching the travel independent valve to the independently feeding position, and is switched to the inactive position by the pilot pressure for switching the travel independent valve to the merging position.

* * * * *